US005604394A

United States Patent [19]

Saito et al.

[11] Patent Number: 5,604,394

[45] Date of Patent: Feb. 18, 1997

[54] IMAGE DISPLAY APPARATUS

[75] Inventors: Masato Saito; Ryo Suzuki; Tetsuya Shiroishi; Kouichi Sakurai; Yoshio Yamane; Hidenobu Murakami, all of Amagasaki, Japan

[73] Assignee: Mitsubishi Denki Kabushiki Kaisha, Tokyo, Japan

[21] Appl. No.: 256,278

[22] PCT Filed: Nov. 4, 1993

[86] PCT No.: PCT/JP93/01600

§ 371 Date: Jul. 6, 1994

§ 102(e) Date: Jul. 6, 1994

[87] PCT Pub. No.: WO94/11896

PCT Pub. Date: May 26, 1994

[30] Foreign Application Priority Data

Nov. 6, 1992 [JP] Japan ..... 4-296821

[51] Int. Cl.[6] ..... H01J 29/70; H01J 1/62

[52] U.S. Cl. ..... 313/422; 313/495; 313/496; 313/497; 313/493

[58] Field of Search ..... 313/422, 495, 313/497, 496, 498, 493, 461, 477 R, 411, 412, 413, 414, 402, 408

[56] References Cited

U.S. PATENT DOCUMENTS

| | | | |
|---|---|---|---|
| 4,804,887 | 2/1989 | Miyama | 313/495 |
| 4,853,586 | 8/1989 | Peters | 313/422 |
| 4,928,041 | 5/1990 | Mayer et al. . | |
| 4,955,681 | 9/1990 | Sekihara et al. | 313/495 |
| 5,134,338 | 7/1992 | Shiratori | 313/422 |
| 5,189,335 | 2/1993 | Sekihara | 313/422 |
| 5,191,259 | 3/1993 | Hayashi | 313/497 |
| 5,202,609 | 4/1993 | Tomii | 313/422 |

FOREIGN PATENT DOCUMENTS

| | | |
|---|---|---|
| 316871 | 5/1989 | European Pat. Off. . |
| 2742555 | 9/1977 | Germany . |
| 56-71255 | 6/1981 | Japan . |
| 60-84745 | 5/1985 | Japan . |
| 4019947 | 11/1990 | Japan . |

*Primary Examiner*—Sandra L. O'Shea
*Assistant Examiner*—John Ning
*Attorney, Agent, or Firm*—Burns, Doane, Swecker & Mathis, LLP

[57] ABSTRACT

It is an object of the present invention to provide an image display apparatus which is light and thin and is manufactured with reduced cost and which assures a clear image with no luminance unevenness over the entire screen. The image display apparatus includes: a string like hot cathode for emitting electrons; a perforated cover electrode for leading out and accelerating the electrons emitted from the cathode; a control electrode disposed substantially parallel with the cathode and having an electron-pass aperture permitting an electron beam to pass therethrough, the control electrode being adapted to control the electron beam; a luminous element which emits light when irradiated with the electron beam and is disposed on a curved surface; and a focusing electrode disposed between the control electrode and the luminous element, the focusing electrode being divided into focusing electrodes. Where the luminous element, the focusing electrode and the control electrode comprise respective curved surfaces and the string like hot cathode and the perforated cover electrode are formed on a flat plane, a second grid is provided between the control electrode and the perforated cover electrode.

17 Claims, 22 Drawing Sheets

IMAGE DISPLAY APPARATUS

TECHNICAL FIELD

The present invention relates to a flat-type image display apparatus. More particularly, it relates to an improved image display apparatus with less luminance unevenness.

BACKGROUND ART

FIGS. 16 and 17 are, respectively, an exploded perspective view of a conventional flat-type image display apparatus as disclosed in, for example, Japanese Unexamined Patent Publications Nos. 226949/1991 and 184239/1988 and an enlarged, partially broken away view of a principal part of another example. In FIGS. 16 and 17, numeral 1 denotes string like hot cathodes each of which is connected to a support and emits electrons when energized, and numeral 3 denotes perforated cover electrodes each covering each string like hot cathode 1 and each elliptically shaped in section. Each cover electrode 3 has small apertures permitting electrons to pass therethrough and serves to lead electrons out of the corresponding string like hot cathode 1 when an appropriate potential is applied. An electron-emitting source 40 comprises the string like hot cathodes 1, perforated cover electrodes 3 and back electrodes 42 fixing the cover electrodes 3 arranged in parallel and each assuming a potential equal to that of the corresponding cover electrode 3. Numeral 8 denotes a front glass which is coated on the inner surface thereof with three types of luminous elements (not shown) in a dotted or striped manner and with an aluminum film (not shown) covering these luminous elements for electric conduction, the luminous elements being adapted to be excited by electrons emitted from the electron-emitting source 40 to emit light in respective colors, i.e., red, green and blue.

In such a configuration, an application of a voltage of about 5 to about 30 kV to the aluminum film of the front glass 8 causes electrons to accelerate and thereby the luminous elements (not shown) to be excited to emit light. Numeral 4 denotes a control electrode for permitting or shutting off the passage of electrons led out by each cover electrode 3 toward the front glass 8, the control electrode being interposed between the front glass 8 and the string like hot cathodes 1. Numeral 10 denotes a focusing electrode to be applied with a predetermined voltage for causing an electron beam having passed through an electron-pass aperture 4*a* of the control electrode 4 to pass through an electron-pass aperture 10*a* and to be focused upon the corresponding dot of the luminous element. As shown in FIG. 17, the control electrode 4 includes a surface-insulative substrate 5 having electron-pass apertures 4*a* corresponding to pixels formed on the front glass 8, for example, a surface-insulative substrate 5 formed by coating an etch-perforated metallic substrate with an insulating film, a first control electrode group 6A including metallic electrodes 6 which are patterned like stripes having electron-pass apertures and arranged on the lower side of the surface-insulative substrate 5, or on the electron-emitting source 40 side, corresponding to respective columns of pixels, and a second control electrode group 7A, similar to the former group, including metallic electrodes 7 which are patterned like stripes having electron-pass apertures and arranged on the upper side of the surface-insulative substrate 5 corresponding to respective rows of pixels. Each metallic electrode of the first and second control electrode groups 6A and 7A is formed of, for example, a nickel film. The first and second control electrode groups 6A and 7A are insulated from each other by a nickel-free portion existing within each electron-pass aperture though nickel penetrates thereinto from both sides. The first control electrode group 6A further includes isolation grooves 44, or nickel-free insulating grooves, which extend between adjacent electron-pass apertures 4*a* in the direction perpendicular to the string like hot cathode 1. Similarly, the second control electrode group 7A includes isolation grooves 45 extending in the direction perpendicular to the isolation grooves 44 of the first control electrode group 6A. These are disposed within a sealed enclosure in the form of flat panel, the inside of which is kept in a vacuum state. Each of the electrodes is usually disposed in a flattened manner by means of a fix-hold member (not shown) and electrically connected to the outside through a seal portion provided on a lateral surface of the sealed enclosure.

FIGS. 18, 19(*a*) and 19(*b*) also illustrate another conventional flat-type image display apparatus. FIG. 19(*a*) is a perspective view of the arrangement of control electrodes 4 shown in FIG. 18, and FIG. 19(*b*) an enlarged view of a portion thereof. In FIGS. 18, 19(*a*) and 19(*b*) same numerals are used to denote corresponding parts of FIGS. 16 and 17, and the descriptions on such parts are omitted. This example has front glass 8 which has a curved shape and is so structured as to allow stress relaxation (to be described later) to be encouraged and the overall apparatus to be lightened. Further, as shown in FIGS. 19(*a*) and 19(*b*) this example has first control electrode group 6A and second control electrode group 7A which comprise stripe-like metallic electrodes 6 and stripe-like metallic electrodes 7, respectively, instead of the metallic film penetrating into electron-pass apertures of insulating substrate 5. These electrodes 6 and 7 are bonded to the insulating substrate 5 in such a manner that their electron-pass apertures are coincident with the corresponding electrode-pass apertures of the insulating substrate 5 thereby defining electron-pass apertures 4*a* of the control electrodes 4.

Description on the operation is as follows:

Thermoelectrons emitted from the string like hot cathode 1 are led out by a positive potential of about 5 to about 40 V applied to the perforated cover electrode 3, the positive potential being relative to the average potential of the string like hot cathode 1 assumed as a reference potential (hereinafter this average potential will be assumed to be 0 V). Further, by applying a positive potential of about 20 V to about 100 V relative to the potential of string like hot cathode 1 to one electrode of the first control electrode group 6A comprising metallic electrodes 6 arranged in the direction perpendicular to the string like hot cathode 1, the thermoelectons are drawn toward this electrode and reach the control electrode 4. This apparatus is designed such that the density of an electron beam on the surface of any metallic electrode of the first control electrode group 6A is made substantially uniform by adjusting the elliptical shape of the perforated cover electrode 3, the position of the first control electrode group 6A and the voltage to be applied to each metallic electrode 6.

It should be noted that although the operation of this control electrode 4 is not described in Japanese Unexamined Patent Publication No. 184239/1988, it is similar to the operation of typical matrix-type displays as disclosed in, for example, Japanese Unexamined Patent Publication Nos. 172642/1987, 126688/1989 and 226949/1991.

If only one metallic electrode 6 of the first control electrode group 6A assumes a positive potential (on-state) while the others assume 0 V or negative potential (off-state), the electrons emitted from the string like hot cathode 1 are attracted only by that control electrode 6 at a positive potential and enter each electrode-pass aperture 4*a* of this control electrode 6. However, not all the electrons entering the aperture pass therethrough toward the front glass 8. When the second control electrode group 7A is made to assume 0 V or negative potential, a negative potential region is produced by the second control electrode group 7A, so that the electrons stop within the electron-pass aperture 4*a*.

Consequently, electrons are allowed to pass through only the electron-pass aperture 4*a* lying at the intersection of the metallic electrode, being applied with a positive potential, of the first control electrode group 6A and the metallic electrode, being applied with a positive potential (for example 40 V to 100 V), of the second control electrode group 7A. The electrons having passed through the aperture 4*a* cause the luminous element positioned coincident with the aperture 4*a* to emit light. Therefore, a desired pixel display can be achieved by controlling the application of voltage to metallic electrodes 6 and 7 so that the intersection thereof is located corresponding to a desired position.

The luminance of each pixel is controlled by adjusting the on-state duration of each electrode of the second control electrode group 7A.

In this case, electron beam 2 (refer to FIG. 18) passing through the electron-pass aperture 4*a* is required to be focused within a phosphor dot corresponding to the aperture 4*a*. If the electron beam 2 passing dot of a luminous element through the electron-pass aperture 4*a* is incident on another too, color fringing will occur in the resulting image, or unclear contour of the image will result. For that reason, the focusing electrode 10 is provided for the purpose of controlling the path of the electron beam so that the electron beam is incident within a desired dot of a luminous element by applying an appropriate voltage to the focusing electrode.

Flat-type image display apparatus utilizing electron beam need to have electron-passing areas all kept in a vacuum and hence require a sealed vacuum enclosure. Where an image display apparatus is sold as a practical commercial article, for example, a television set for domestic use, it is desirable that the vacuum enclosure be made as light and thin (or small in the length in the direction perpendicular to the screen) as possible.

Where the above-mentioned conventional flat-type image display apparatus have a screen size as small as about 16 in., the glass thickness of the sealed enclosure does not need to be made so thick. However, where the screen size is as large as 20 in. or greater, the glass thickness needs to be made not smaller than about 20 mm to provide the enclosure with a sufficient strength against the vacuum. This results in a difficulty in reducing the weight of display apparatus of this type.

The most effective approach to lighten the vacuum enclosure is to shape the enclosure into a sphere ensuring the least stress concentration. However, this is against the demand mentioned above for a thinner enclosure. Assuming that the vacuum enclosure of a flat-type display apparatus is a box-like vacuum enclosure 11, as shown in section at FIG. 20(*a*), for accommodating an image display unit 11*a*, stress concentration caused by the pressure difference between the inside and outside of the vaccum enclosure 11 will occur at and angular portions and central portions of the screen indicated by arrows. If a reinforcing member is added to the enclosure at the angular portions or like portions to withstand such stress, the weight of the enclosure increases significantly. Therefore, the vacuum enclosure 11 in the form of oval in section as shown in FIG. 20(*b*) is most easily realized with the aim of making the enclosure 11 light and thin.

Typically, the phosphor for use in a television set is coated directly on the inner surface of the front glass forming part of the vacuum enclosure. This is because the provision of another glass plate or the like intermediate the front glass and the luminous element would cause light to reduce and hence the luminance of the display screen to decrease, because the screen would provide an unclear image even though the space between the front glass and the glass plate coated with the luminous element is placed in a vacuum state because the manufacturing cost is low, and like reasons.

In consequence, it is appreciated that the front glass of the vacuum enclosure needs to be shaped curved as having a curvature as shown in FIG. 18 so as to have a lightened weight and a reduced thickness, and that the luminous element is desirably coated on the inner surface of the front glass.

In the structure shown in FIG. 18, however, since the control electrode 4 and focusing electrode 10 are flat though the front glass is curved, there is a difference in the distance from the control electrode 4 or focusing electrode 10 to the front glass coated with the luminous element between end portion and central portion of the screen.

As described above, the focusing electrode 10 is applied with a desired voltage to focus electron beam 2 within a desired dot of luminous element. However, as shown in the enlarged sectional view at FIG. 21, where there is only one focusing electrode 10 and the voltage capable of being applied is fixed, the beam diameter reaches the minimum (becomes just focused) at only one point $P_1$. Accordingly, where the distance Daf between the focusing electrode 10 and the front glass 8 provided with the aluminum film serving as the anode on the inner side thereof is uneven, it is impossible to cause the electron beam 2 to assume a minimum beam diameter at overall surface of the front glass 8. Stated otherwise, the beam diameter of electron beam 2 on the front glass is not fixed at different locations on the screen of the front glass 8 and, hence, the electron beam 2 becomes "fuzzy" at point $P_2$ as shown in FIG. 18.

Where the electron beam 2 becomes "fuzzy", for example, the beam diameter of electron beam 2*a* exceeds the size of a pixel as shown in FIG. 22, black matrix 12 is also irradiated with the electron beam 2*a*, so that the intensity of the beam to be applied onto luminous element 9 decreases and, hence, the luminous intensity of the corresponding pixel decreases. Therefore, when the overall screen is viewed, luminance unevenness occurs Alternatively, where the electron beam 2 is an electron beam 2*b* having a beam diameter such that the beam extends from the subject pixel to pixels adjacent thereto over the pitch therebetween, the pixels other than the one desired to emit light are also caused to emit light, so that phenomena are developed such as color fringing and blurred contour of the resulting image.

Accordingly, when point $P_2$ at which the electron beam 2 becomes "fuzzy" appears in a portion of the screen, luminance unevenness, color fringing or the like occurs at point $P_2$. This is a fatal defect to a commercial article having a display screen.

To overcome such problem, there is disclosed in, for example, Japanese Unexamined Patent Publication No. 19947/1992 a structure wherein the wall of a sealed vaccum enclosure on light-emitting means side, the light-emitting means (phosphor-coated surface), an electron beam control electrode and an electron beam lead-out electrode are curved as having respective curvatures substantially equal to each other, while in addition a correction means is provided to render the quantity of electron beam incident on the electron beam lead-out electrode uniform in the horizontal direction; or a structure wherein the wall of the sealed vacuum enclosure on the light-emitting means side, a string like hot cathode, the electron beam lead-out electrode, electron beach control electrode and the light-emitting means are shaped into curved lines or curved surfaces as having respective curvatures substantially equal to each other. In this structure, however, the electron beam lead-out electrode cannot be applied to an electrode (perforated cover electrode) elliptically shaped in section and adapted to cover each string like hot cathode since the electron beam lead-out electrode is in the form of one plate and is a common electrode for all the string like hot cathodes, for avoiding the occurrence of substantial deformation thereof even though it is curved. In more detail, each perforated cover electrode needs to have a curvature small enough to form an elliptic section and further another curvature harmonizing with the curved surface of the front glass. In addition, the perforated cover electrode is located very near the string like hot cathode and hence is heated thereby to elevated temperatures, leading to severe thermal deformation. As a result, there arise problems that the luminance distribution on the display screen is possible to be extremely degraded, insulation failure between the perforated cover electrode and the cathode becomes likely, the life time of the cathode is shortened, and the like.

DISCLOSURE OF THE INVENTION

An object of the present invention is to provide a highly reliable image display apparatus which is lightened and thinned by employing a sealed vacuum enclosure comprising a curved surface and is capable of displaying a clear image free of luminance unevenness over the entire screen and of being manufactured with less cost.

The present invention relates to an image display apparatus comprising: a cathode for emitting electrons; a perforated cover electrode for leading out and accelerating the electrons emitted from the cathode; a control electrode disposed substantially in parallel with the cathode and having an electron-pass aperture permitting the emitted electrons to pass therethrough, the control electrode being adapted to control an electron beam passing through the electron-pass aperture; a luminous element which emits light when irradiated with the emitted electrons and comprises a curved surface; and a focusing electrode disposed between the control electrode and the luminous element and having a means for correcting the beam diameter of the electron beam on the luminous element which varies in accordance with a variation in the distance between the luminous element and the control electrode shaped flat.

The aforesaid means for correcting the beam diameter of the electron beam on the luminous element is realized by: dividing the focusing electrode into a plurality of electrodes and applying different voltages to respective electrodes; making the ratio of the distance between the focusing electrode and the control electrode to that between the focusing electrode and the luminous element substantially constant over the entire display screen area; or varying the diameter of the electron-pass aperture in accordance with the distance between the focusing electrode and the luminous element.

The present invention also relates to an image display apparatus comprising: a cathode for emitting electrons; a perforated cover electrode for leading out and accelerating the electrons emitted from the cathode; a control electrode having an electron-pass aperture permitting the emitted electrons to pass therethrough and adapted to control an electron beam passing through the electron-pass aperture; a luminous element which emits light when irradiated with the emitted electrons; a focusing electrode disposed between the control electrode and the luminous element and having an electron-pass aperture permitting the emitted electrons to pass therethrough; and a second grid disposed between the control electrode and the perforated electrode and having an electrode-pass aperture for correcting the beam diameter of the electron beam on the luminous element which varies in accordance with a variation in the distance between the luminous element and the cathode; the luminous element, the focusing electrode and the control electrode comprising respective curved surfaces having a substantially equal curvature, the perforated cover electrode and the cathode respectively comprising a plurality of perforated cover electrodes and a plurality of cathodes, the perforated cover electrodes and the cathodes being disposed on a curved surface having a curvature substantially larger than the former cuvature or on a flat plane.

The term "a substantially equal curvature" is herein meant to express such an extent that the respective distances between the luminous element and individual electrodes are almost equal to each other and, hence, a problem of luminance unevenness due to a variation in the beam diameter of the electron beam on the luminous element will not occur.

The aforesaid second grid may comprise a curved surface having a curvature larger than or substantially equal to that of the control electrode or a flat plane.

To improve the uniformity ratio of electron beam, preferably, the perforated cover electrodes and the cathodes may be arranged with increasing pitch as viewed in the direction from a central portion to a peripheral portion; the curved surface or flat plane on which the perforated cover electrodes and the cathodes are formed may be spaced apart from the second grid by a distance 1.0 to 6.0 times as large as the pitch at which the cathodes are arranged in the array; the rate of hole area of at least one of the second grid and the perforated cover electrode may be made large in a central portion and made small in a peripheral portion when viewed in the arrangement pitch direction of the perforated cover electrodes and cathodes; the perforated cover electrode and the cathode may be disposed such that the distance therebetween is small in the central portion and large in the peripheral portion when viewed in the arrangement pitch direction of the perforated cover electrodes and cathodes; or the second grid may be divided into at least three sections in such arrangement pitch direction so that the central section of the second grid is applied with a large voltage and the peripheral sections thereof with a small voltage.

According to the present invention, for example, the focusing electrode is dividedly formed, and each divided electrode can be applied with a voltage inversely proportional to the distance by which it is spaced apart from the luminous element serving as the anode. Accordingly, it is possible to make the beam diameter of an electron beam on the display screen substantially uniform and small over the entire screen and hence to display a clear image over the entire screen.

Further, according to the present invention, the curvature of each of the focusing electrode and control electrode is made substantially equal to that of the curved surface of the luminous element, while the second grid is provided between the control electrode and the perforated cover electrode. Such arrangement allows the second grid to correct the location at which electron beam assumes its minimum beam diameter, whereby the uniformity ratio of electron beam incident on the control electrode can be made constant even though the distance between the perforated cover electrode and the control electrode varies. This assures display of a clear image with little luminance unevenness over the entire screen.

Furthermore, since the surface of the luminous element, i.e., the wall of the vacuum enclosure is curved, stress concentration can be avoided, and the vacuum enclosure can be lightened and thinned. In addition, since each electrode can be made planar, it is possible to minimize the manufacturing costs.

BEST MODE FOR CARRYING OUT THE INVENTION

An image display apparatus according to the present invention will now be described with reference to the drawings.

EXAMPLE 1

Figure 1:
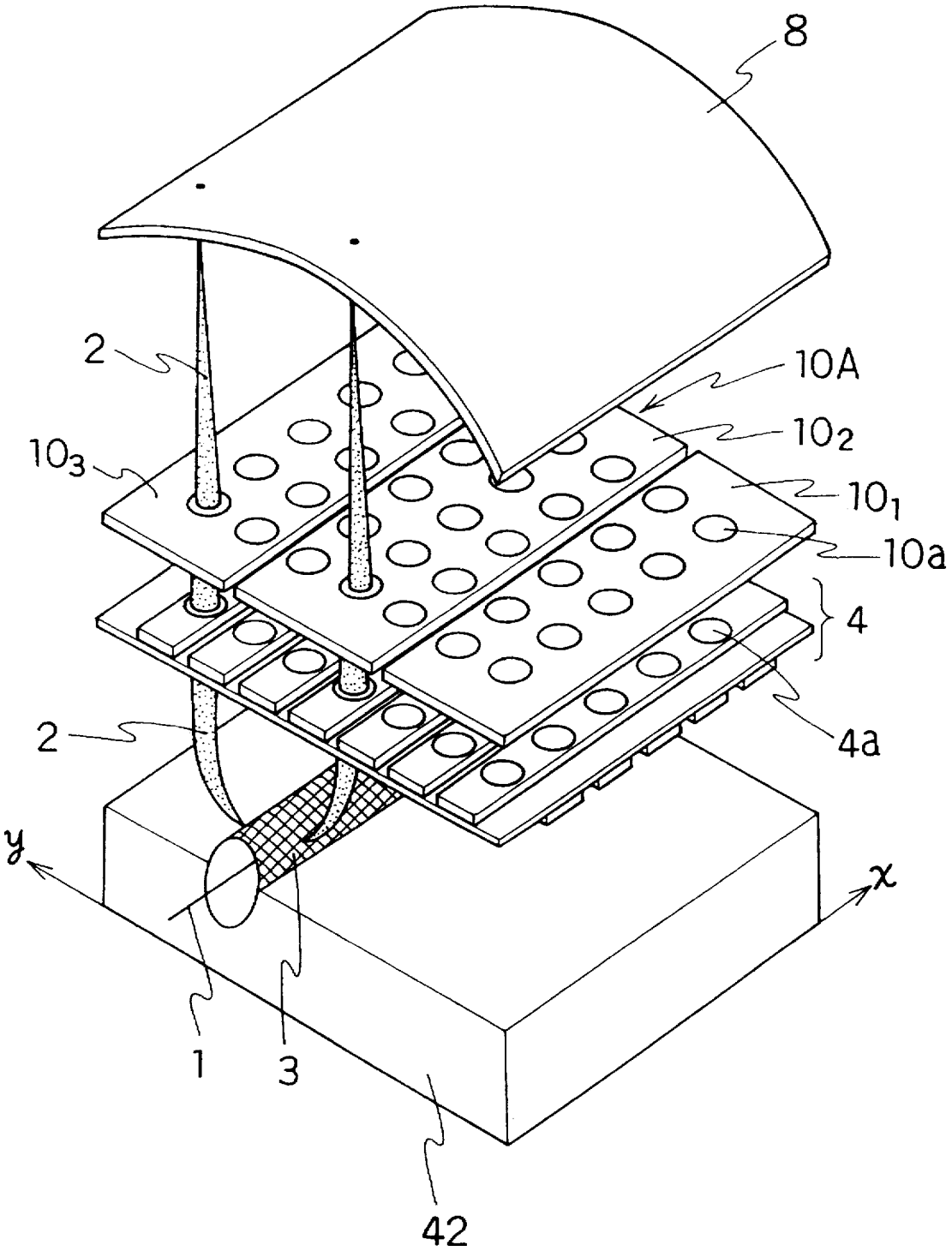
FIG. 1 is an exploded perspective view of a principal part of one example of an image display apparatus according to the present invention for illustrating the arrangement thereof.

FIG. 1 is an exploded explanatory view of a principal part of one example of the image display apparatus according to the present invention, in which same numerals are used to denote same parts of the foregoing FIGS. 16 to 22 and the description on such parts is omitted. This example includes a means for correcting the beam diameter of electron beam 2 on the surface of the front glass 8 which varies in accordance with a variation in the distance between the control electrode 4 or the focusing electrode 8 and the front glass 8, the means comprises focusing electrode 10 A divided into, for example, three electrodes which are applied with respective different voltages so as to focus electron beam 2 on the luminous element of the front glass 8. The number of the divided electrodes has to be at least two since the central portion and side portions of the focusing electrode need to be independently controlled. Although a larger number of divided electrodes assures more accurate control, it is preferable to divide the focusing electrode into three to nine electrodes in view of the complexity in manufacture and use. In FIG. 1, the focusing electrode 10 A is divided into first, second and third focusing electrodes $\mathbf{10}_1$, $\mathbf{10}_2$ and $\mathbf{10}_3$ and is interposed between the front glass 8 and the control electrode 4. The focusing electrode 10A has a multiplicity of electron-pass apertures 10*a* corresponding to respective pixels of the display screen, each of which allows electron beam 2 to pass therethrough toward the front glass 8 serving as an anode and formed on the inner surface thereof with the luminous element (not shown) adapted to emit light in red, green and blue and to be focused thereon. Electron beam 2 passing through each of the multiplicity of electron-pass apertures 10*a* causes the luminous element to emit light thereby displaying a desired image. The luminous elements of the front glass 8 and the electron-pass apertures 10*a* of the focusing electrode 10A are arranged at a pitch substantially coincident with the pitch at which the electron-pass apertures 4*a* of the control electrode 4 are arranged. Each electron-pass aperture 10*a* and each electron-pass aperture 4*a* are positioned to share the center axis.

Further, in the focusing electrode 10A thus configured, the divided focusing electrodes $\mathbf{10}_1$, $\mathbf{10}_2$ and $\mathbf{10}_3$ are applied with respective voltages different from each other so as to decrease the beam diameter of electron beam 2 on the display screen. These voltages are made to vary as a function of the distance between the control electrode 10A and the front glass 8.

To determine how much voltage should be applied to each divided focusing electrode, a surface of a luminous element with no black matrix was prepared, and variations in the beam diameter of electron beam on the front glass were measured while the voltages applied to the focusing electrode 10A and the distance between the control electrode and the front glass were made to vary. In this experiment, the distance between the control electrode 4 and the focusing electrode 10A was set to 0.1 mm and the voltage for accelerating electrons moving from the control electrode 4 to the front glass 8 was set to 10 kV.

Figure 2:
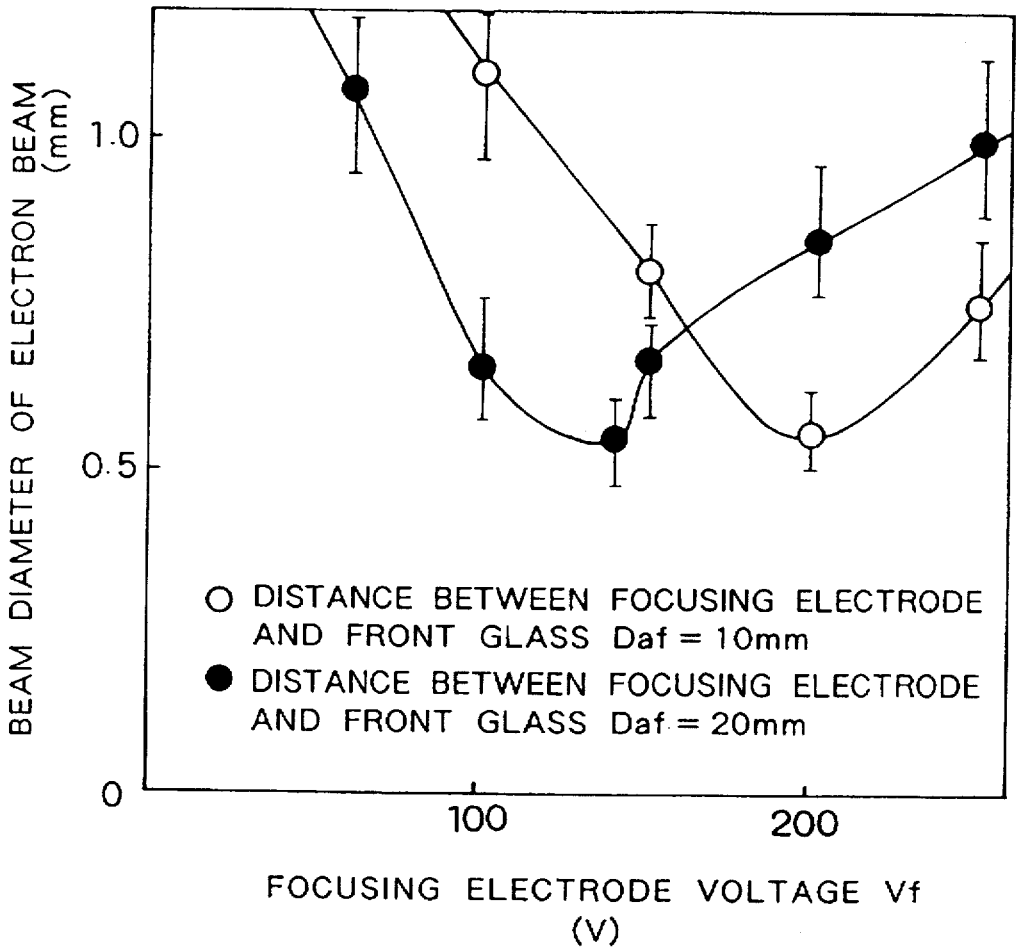
FIG. 2 is a graphic representation showing characteristic curves representing the relation between the distance between the front glass and the focusing electrode and the focusing electrode voltage needed to decrease the beam diameter of electron beam on the front glass.

As shown in FIG. 2, where the distance between the focusing electrode 10A and the front glass 8 was fixed, the beam diameter of electron beam on the front surface of the display screen assumed a minimum value at certain focusing electrode voltage (the voltage applied to the focusing electrode 10A). Specifically, the beam diameter of the electron beam assumed a minimum at a focusing electrode voltage of about 200 V where the distance between the control electrode and the front glass was set to 10 mm, at a focusing electrode voltage of about 140 V where such distance was set to 20 mm, and at a focusing electrode voltage of about 120 V where the distance was set to 30 mm (not shown). In this experiment, the control electrode voltage ( the voltage applied to the control electrode 4) Vc was 80 V.

It was found that, at least in the range of conditions of this experiment, the beam diameter of electron beam on the display screen could be decreased by applying such a voltage to the focusing electrode that distance Daf between the front glass 8 and the focusing electrode 10A was inversely proportional to the voltage resulting from subtracting control electrode voltage Vc from focusing electrode voltage Vf, as represented by the following expression:

$$\text{Constant} \approx (Vf - Vc) * Daf \quad (1)$$

Accordingly, it is possible to make the beam diameter of electron beam uniform and small over the entire display screen by dividing the focusing electrode 10A as shown in FIG. 1 and applying a voltage so as to minimize the beam diameter of electron beam 2, i.e., applying the voltage appearing in FIG. 2 to each of the divided focusing electrodes $\mathbf{10}_1$, $\mathbf{10}_2$ and $\mathbf{10}_3$ in accordance with distance Daf between the focusing electrode 10A and the front glass 8 formed with the anode on the inner surface thereof.

While the distance between the control electrode 4 and the focusing electrode 10A was set to 0.1 mm, setting the distance twice as large as 0.1 mm, or to 0.2 mm and the distance between the focusing electrode and the front glass to 10 mm caused the electron beam to assume a minimum beam diameter at a focusing electrode voltage of about 150 V. That is, the voltage required to be applied to the focusing electrode 10A is also dependent on the distance between the control electrode 4 and the focusing electrode 10A. Further, it was found that the path of the electron beam, hence the beam diameter thereof, could also be controlled by adjusting the distance between the control electrode 4 and the focusing electrode 10A.

To be described next is one example of a method for manufacturing this focusing electrode.

The focusing electrode 10A may be formed by perforating an electric conductor substrate made of a material such as stainless steel or aluminum by an etching technique to define electron-pass apertures 10*a* extending through the substrate. The focusing electrode 10A may be fixed by registering it with the control electrode 4 through an intervening insulator and bonding it thereto.

Figure 3A:
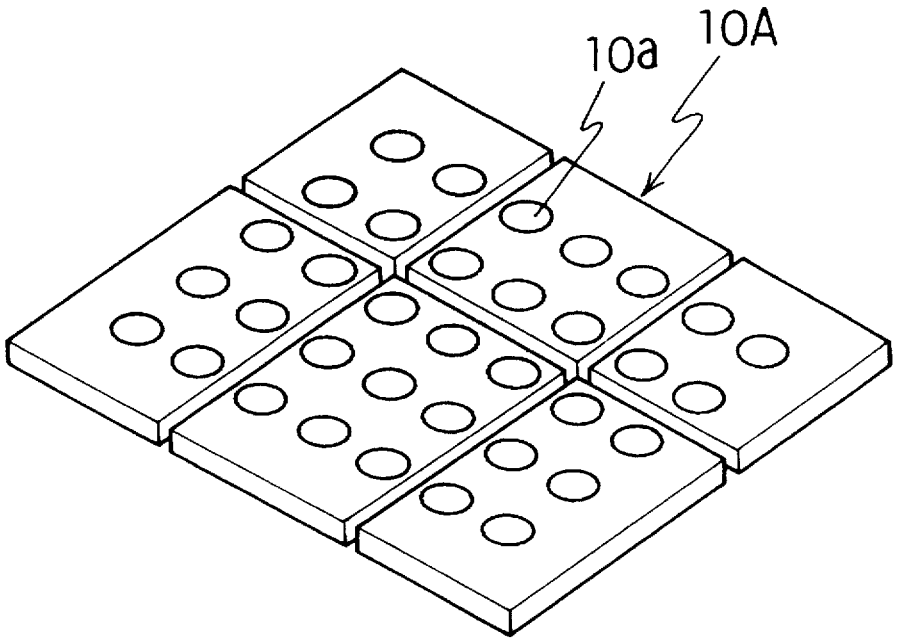
FIGS. 3(*a*) and 3(*b*) are perspective views illustrating an example of the focusing electrode of divided structure.
Figure 3B:
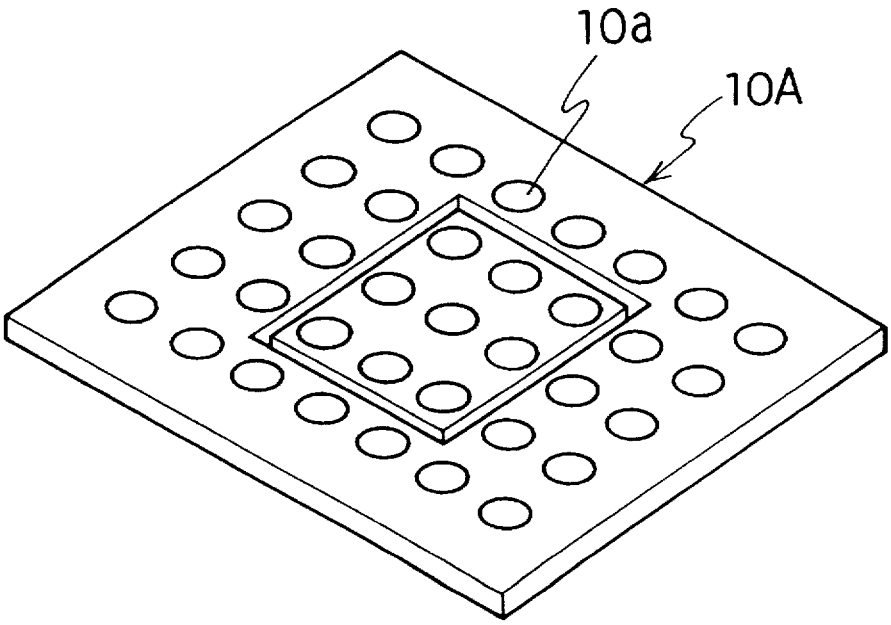

It should be appreciated that although the focusing electrode 10A is divided in the direction indicated by y in FIG. 1 in present Example 1, the focusing electrode 10A may be divided in both directions, i.e., in row and column directions as shown in FIG. 3(*a*) or may be divided concentrically as shown in FIG. 3(*b*). Effects similar to those of the foregoing Example can be given by any display apparatus capable of controlling the path of electron beam 2 in accordance with the distance between the control electrode 4 and the front glass 8.

Further, although the description in Example 1 is directed to the case where the electron-pass apertures 4*a* of the control electrode 4 and the electron-pass apertures 10*a* of the focusing electrode 10A are circularly shaped, effects similar to those of the foregoing example can be obtained even if the aperutures 4*a* and 10*a* are defined in another shape such as a quadrangle.

Further, although Example 1 presents a structure wherein the first control electrode group 6 and the second control electrode group 7 are formed only on the lower and upper surfaces, respecitvely, of the insulator substrate 5 by forming a film thereon, effects similar to those of the foregoing example can be obtained even if each electron-pass aperture 4*a* is coated with the film on its inner wall.

Further, although Example 1 employs a highly electrically-insulative substrate as the insulator substrate 5 on which the first and second control electrode groups 6 and 7 are bondedly disposed, the insulator substrate 5 may be any substrate which is electrically insulative at its surface, for example, a metallic plate coated with an insulator layer formed of an oxide such as ALMITE, nitride or a resin such as polyimide by a vapor deposition process or a like process.

Further, although a space is provided intermediate between the perforated cover electrode 3 and the control electrode 4 in Example 1, an electrode plate, having electron-pass apertures, for applying a predetermined voltage may be provided therebetween. This would make it possible to stably supply heavy current electron beam to the control electrode and hence to effectively improve the luminance of the display screen.

Figure 4:
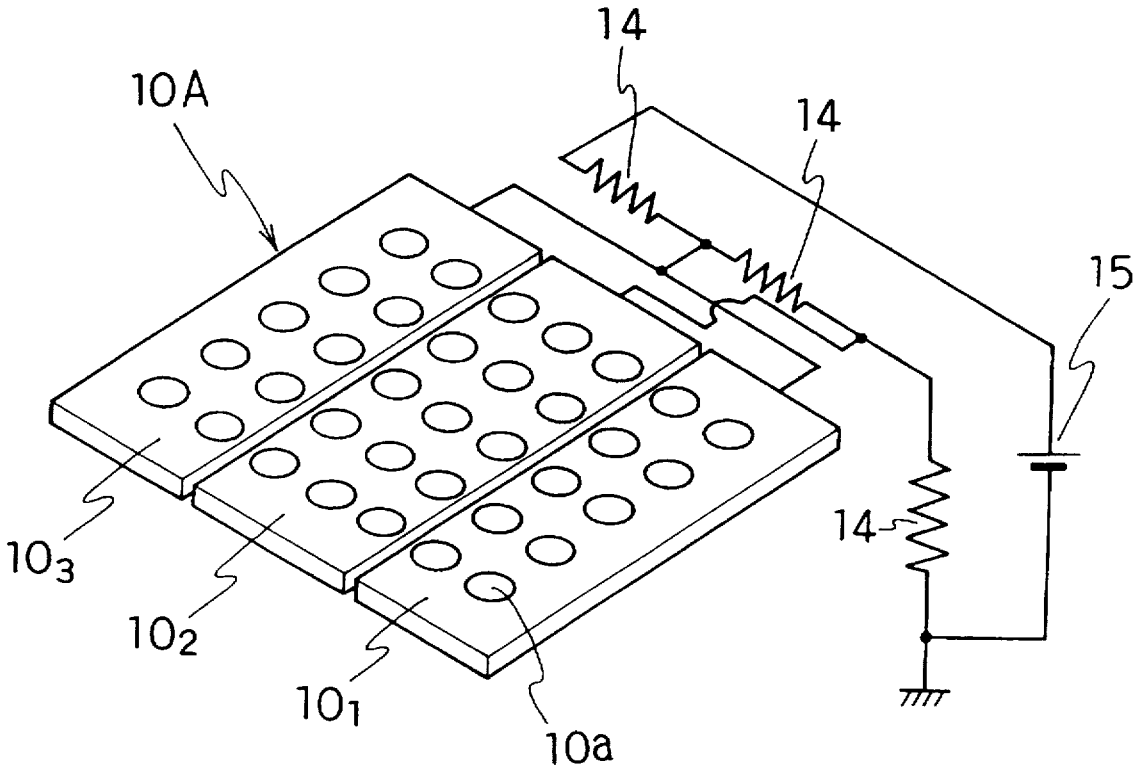
FIG. 4 is an explanatory view for illustrating an example of the way of applying voltage to the focusing electrode.

Further, although there is no description on the way of applying a predetermined voltage to each of the divided focusing electrodes $\mathbf{10}_1$, $\mathbf{10}_2$ and $\mathbf{10}_3$, the so-called resistive divider method, or connecting a resistor 14 between focusing electrodes $\mathbf{10}_1$, $\mathbf{10}_2$ and $\mathbf{10}_3$, may be employed to supply different voltages to respective electrodes from a power source 15 as shown in FIG. 4. This would enable a reduction in the number of power sources for the application of voltage while offering effects similar to those of the foregoing example.

EXAMPLE 2

Figure 5A:
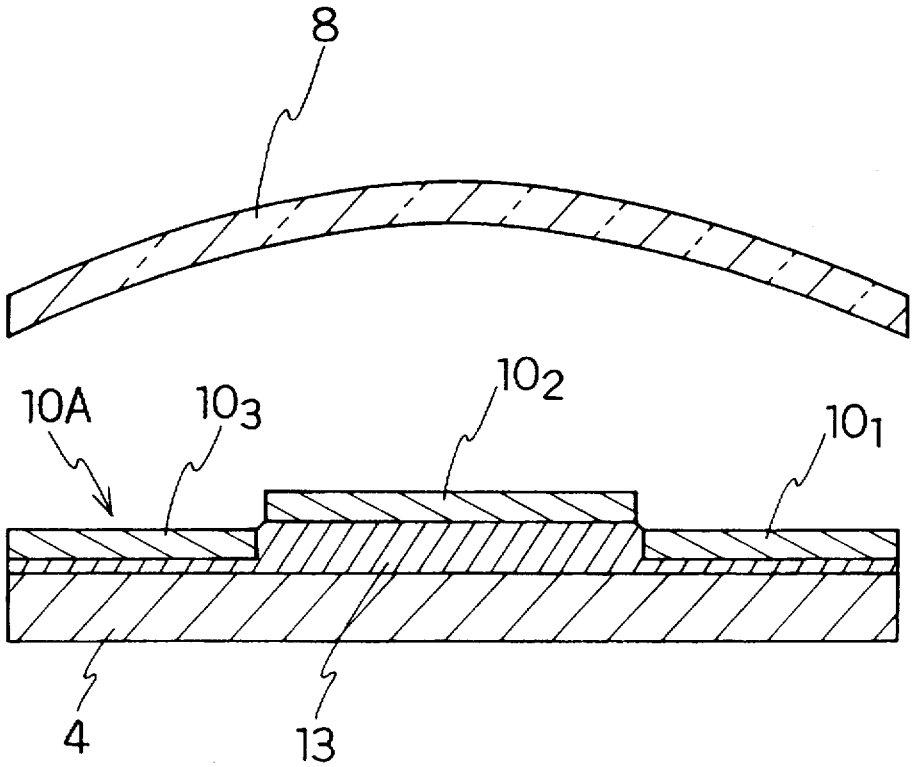
FIGS. 5(*a*) and 5(*b*) are perspective views of an example of a structure for varying the distance between the focusing electrode and the control electrode.
Figure 5B:
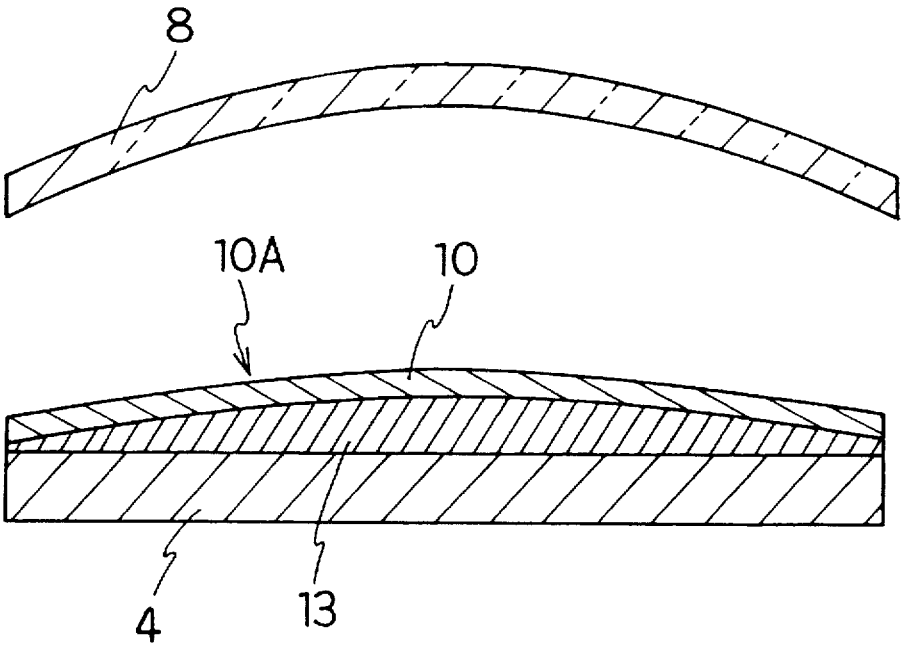

FIG. 5 is an explanatory sectional view of the control electrode 4, focusing electrode 10A and front glass 8 included in another example of the image display apparatus according to the present invention. Other structures are the same as in FIG. 1. This example is characterized in an arrangement such that the ratio of the distance between the control electrode 4 and the focusing electrode 10A to the distance between the focusing electrode 10A and the front glass 8 (luminous element) is made substantially constant over the entire display screen. The term "substantially constant" herein refers to a state where the ratio of one distance to the other is substantially constant, and the beam diameter of electron beam on the display screen is small enough to be kept within a required luminous element, so that there occurs no luminance unevenness, color fluctuation, fuzzy contour or the like. Specifically, when the distance between the control electrode 4 and the focusing electrode 10A becomes large, the electron beam is restricted a little and hence focused at a far point. In contrast, when the distance between the control electrode 4 and the focusing the electrode 10A becomes small, electron beam is more restricted and hence focused at a near point. Therefore, if the ratio of the distance between the control electrode 4 and the focusing electrode 10A to the distance between the focusing electrode 10A and the front glass 8 is made substantially constant, the beam diameter of electron beam can be minimized over the entire display screen without the need of dividing the focusing electrode and applying different voltages to the respective divided electrodes. As described above, since the distance ratio need not necessarily be strictly constant, the focusing electrode may be shaped as having a step as shown in FIG. 5(*a*) or may be formed on a curved surface as shown in FIG. 5(*b*). In forming the focusing electrode, the aforesaid distance can be varied by varying the thickness of a spacer 13 formed of an insulator such as glass, as shown in enlarged section at FIGS. 5(*a*) and 5(*b*). Thus, by constructing an apparatus such that the beam diameter of electron beam 2 on the front glass 8 is minimized over the entire area thereof, there can be obtained effects similar to those of the foregoing example.

EXAMPLE 3

In the foregoing Examples the size of each electron-pass aperture 10*a* of the focusing electrode 10A is fixed. Nevertheless the restriction of the electron beam can be controlled also by varying the size of electron-pass aperture 10*a*. That is, when the diameter of electron-pass aperture 10*a* is small, the electron beam is restricted a large amount and, hence, the beam diameter thereof assumes a minimum at a point near the focusing electrode 10A. When the diameter of electron-pass aperture 10*a* is large, the beam diameter assumes a minimum at a point far from the focusing electrode 10A. Consequently, electron beam 2 can also be controlled by varying the diameter of the electron-pass aperture in accordance with the distance between the focusing electrode 10A and the front glass 8, thus assuring effects similar to those of the foregoing Examples.

The focusing effect of electron beam can be varied also by varying the depth of the electron-pass aperture 10*a*, i.e., the thickness of the focusing electrode 10 instead of varying the diameter of the aperture. Thus, it is also possible to minimize the beam diameter of the electron beam over the entire display screen. Specifically, when the focusing electrode is thick, the focusing effect works strongly and, hence, it is possible to minimize the beam diameter of the electron beam on the display screen. When the focusing electrode is thin, the effect is reversed. Consequently, electron beam 2 can also be controlled by varying the thickness of the focusing electrode 10A, for example, bonding focusing electrodes to each other, thus obtaining effects similar to those of the foregoing Examples.

Figure 6:
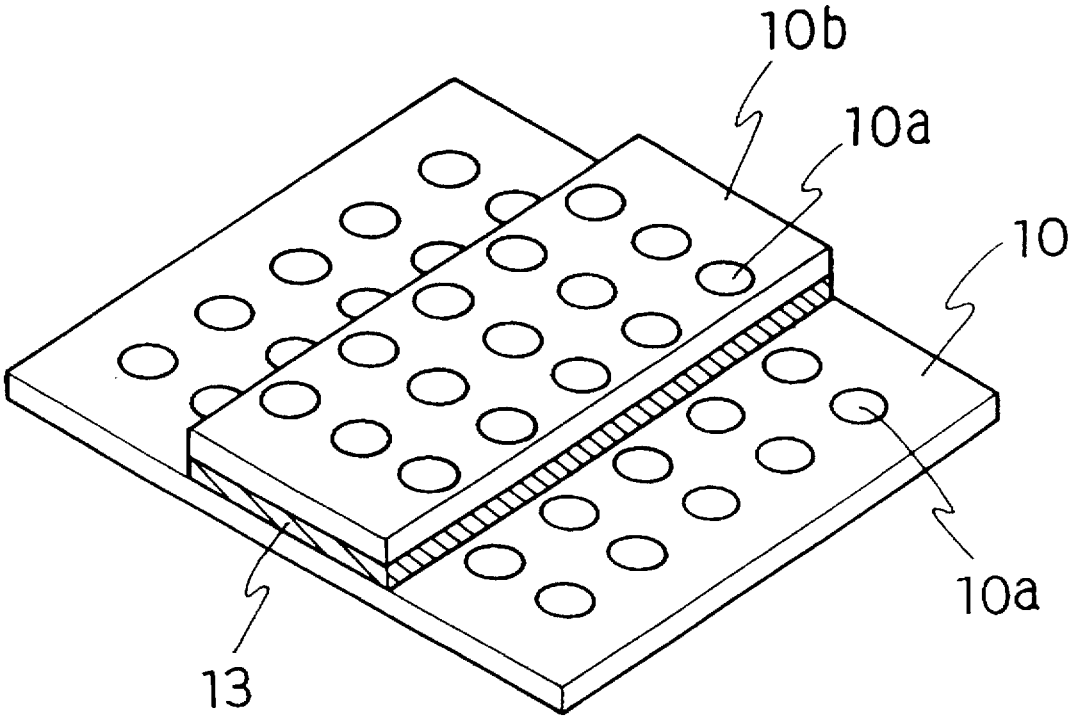
FIG. 6 is a perspective view of an example of another structure of the focusing electrode.

Although the description made in Example 1 is directed to the case where the number of focusing electrodes 10A is fixed (one focusing electrode), it need not necessarily be fixed. Electron beam 2 can also be controlled by employing, for example, the structure shown in FIG. 6 wherein a spacer is provided on a focusing electrode 10 and a focusing electrode 10*b* is added thereto. Hence, effects similar to those of the foregoing Examples can be obtained.

EXAMPLE 4

Figure 7:
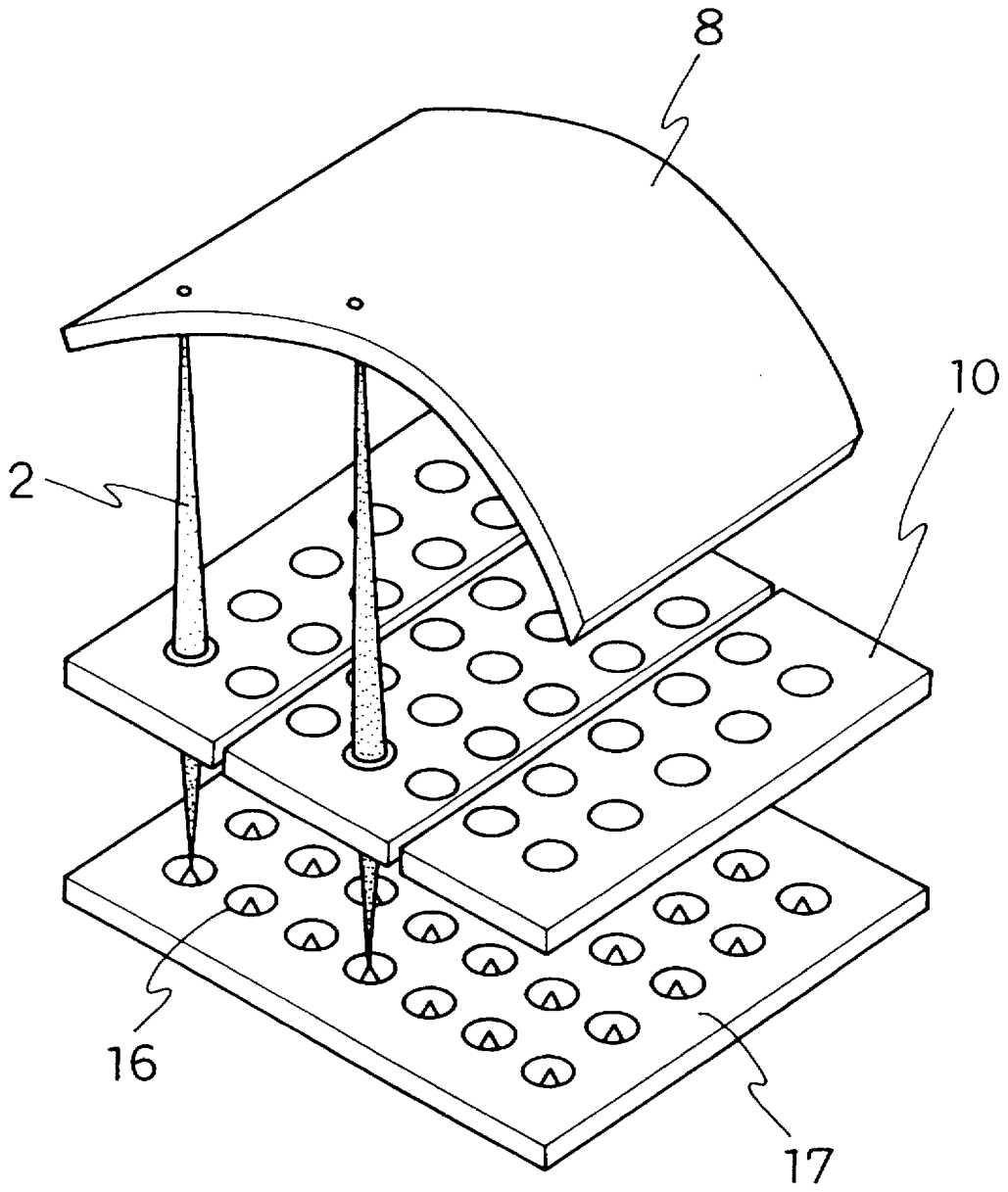
FIG. 7 is a perspective view of one example employing a field-emission cathode as the cathode.

FIG. 7 is an exploded perspective view of a principal part of yet another example of the image display apparatus according to the present invention. This example employs, instead of the string like hot cathode, a cathode 16 of a field emission type electron gun or a thermionic emission type cathode as the cathode. Such an arrangement also offers effects similar to those of the foregoing Examples. Note that in FIG. 7 numeral 17 denotes an electrode for applying lead-out voltage to the field emission type electron gun.

In any of the foregoing Examples the cathodes and the perforated cover electrodes can be disposed on a flat plane. Such configuration is highly reliable and effective in preventing the deformation of the perforated cover electrode due to heat of the hot cathode. The same is true for another type of cathode such as the field emission type electron gun as used in Example 4.

EXAMPLE 5

Figure 8:
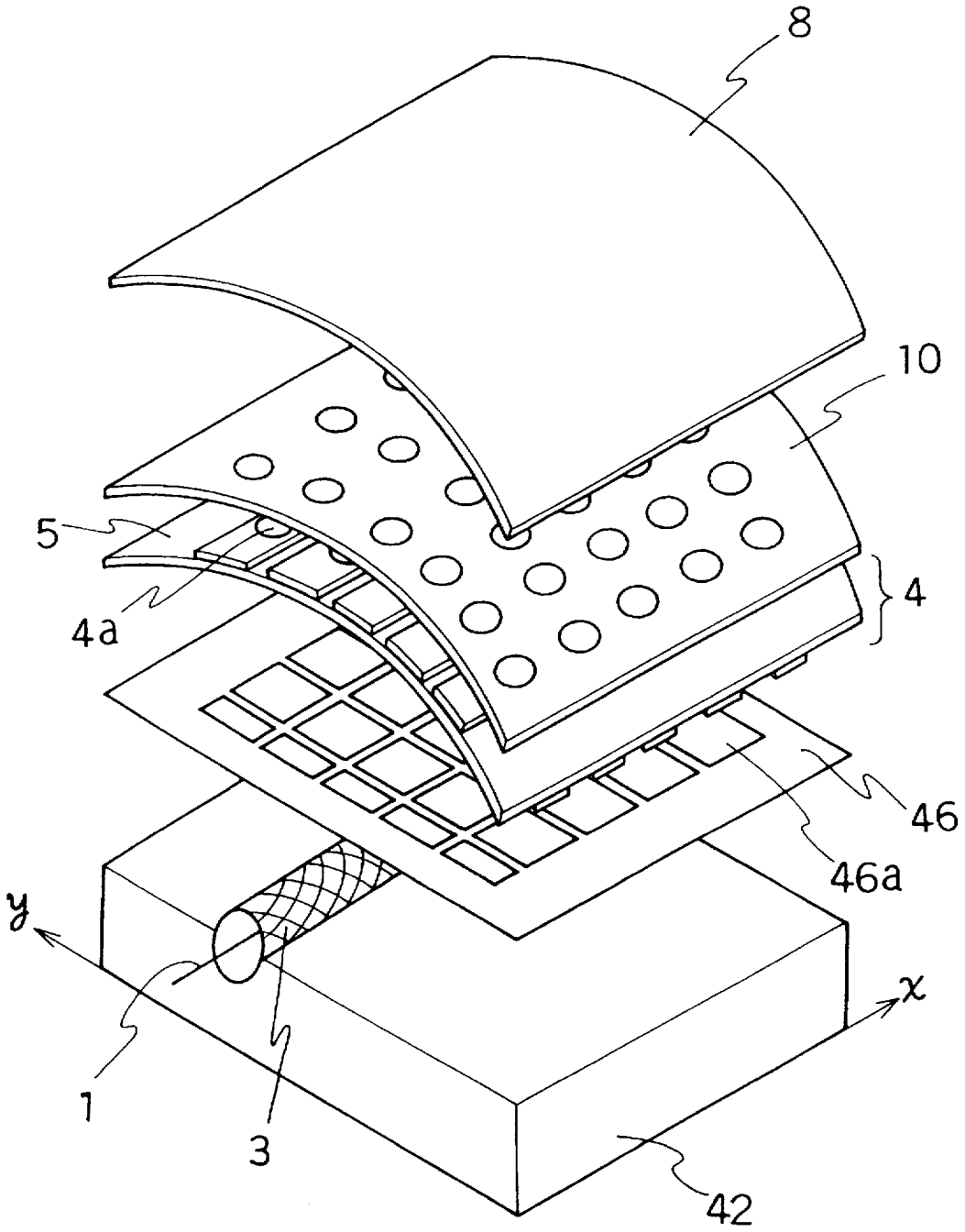
FIG. 8 is an exploded perspective view of a principal part of another example of the image display apparatus according to the present invention for illustrating the arrangement thereof.
Figure 9:
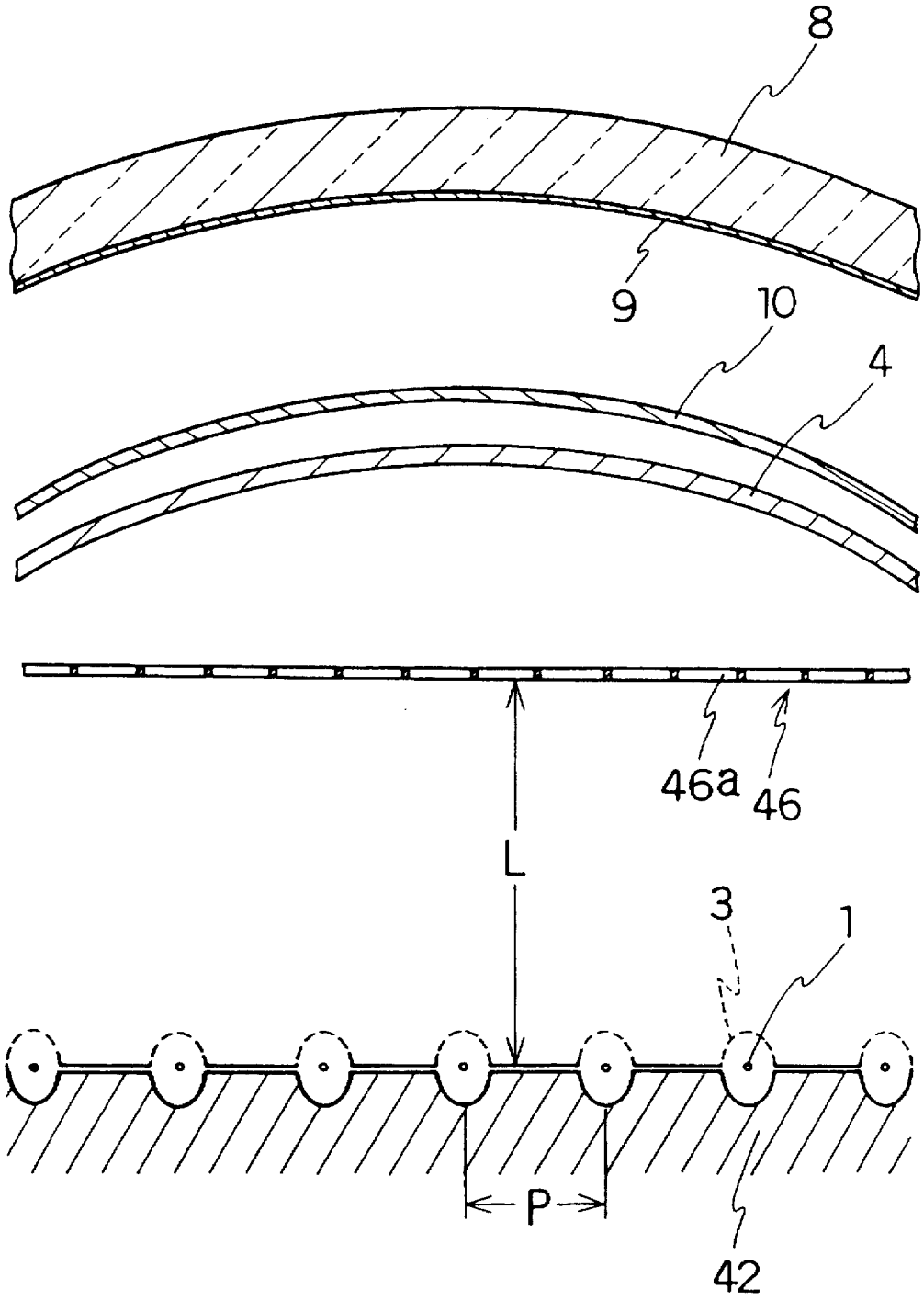
FIG. 9 is a fragmentary front section of the arrangement of another example of the image display apparatus according to the present invention.

FIGS. 8 and 9 are an exploded perspective view and a sectional view, respectively, of yet another example of the image display apparatus according to the present invention. In FIGS. 8 and 9, too, same numerals are used to denote same parts of the foregoing Examples with the descriptions on such parts being omitted. Note that numeral 9 denotes a luminous element. This Example is characterized in that both the control electrode 4 and the focusing electrode 10 are comprised of respective curved surfaces having a curvature substantially the same curvature of the front glass, the string like hot cathode 1 and the perforated cover electrode 3 are disposed on a flat plane, and a second grid 46 is interposed between the control electrode 4 and the perforated cover electrode 3. The second grid 46 is formed by etching a metallic plate such as a stainless steel plate to define electron-pass apertures 46*a* at even pitch and is shaped planar, like a second grid as disclosed in, for example, Japanese Unexamined Patent Publication No. 121014/1993.

To corroborate the effects of the present Example, the present inventors manufactured a flat-type image display apparatus having a front glass 8 of 29 in. in outer size and 24 in. in effective size on an experimental basis. In the thus manufactured image display apparatus, the front glass 8, focusing electrode 10 and control electrode 4 comprised respective curved surfaces having a substantially the same curvature, which was the curvature of a cylindrical curved surface having a radius of about 2000 mm, the second grid 46 was made planar, and the string like hot cathode 1 and the perforated cover electrode 3 are disposed on a planar back electrode 42. The string like hot cathode 1 comprised 39 string like hot cathodes arranged at 12.5 mm pitch in array (in the direction y of FIG. 8). The distance between the back electrode 42 and the second grid 46 was about 15 mm, and the distance between the second grid 46 and the control electrode 4 was about 5 mm at the shortest and about 20 mm at the longest. The second grid 46 comprised a stainless steel sheet of about 0.2 mm thickness having about 1.8 mm-square apertures at about 2 mm pitch defined by etching. The perforated cover electrode 3 was formed by etching a stainless steel sheet of about 0.05 mm thickness to form a mesh configuration having a rate of hole area of 72% and hot working the mesh into an elliptic shape having the minor axis of 2 mm and the major axis of 3 mm.

The thus manufactured image display apparatus was found to be substantially improved in lessening the luminance unevenness in the bridging direction (in the direction x of FIG. 8) in which the cathodes of the string like hot cathode 1 extended and in the arrangement pitch direction (in the direction y of FIG. 8) in which the cathodes of the string like hot cathode 1 are arranged. Further, a change in luminance unevenness with lapse of time was found to be little. Moreover, even in an operation over a prolonged time period there were not found phenomena such that emission current of individual string like cathodes 1 decreased extremely and that the string like hot cathode 1 was short-circuited to the perforated cover electrode 3.

In the experimentarily manufactured apparatus, the ratio of the distance L between the back electrode 42 and the second grid 46 to the arrangement pitch P of the string like hot cathodes 1 was 1.25. When such ratio is less than 1, the uniformity ratio of electron beam on the second grid 46 on the string like hot cathode side is insufficient. This causes the luminance unevenness particularly in the arrangement pitch direction of string like hot cathodes to occur conspicuously, in cooperation with the influence of a variation in the distance between the second grid 46 and the control electrode 4. When the ratio exceeds 6, the rate of the electron beam utilized by the second grid at the same voltage decreases though the uniformity ratio of electron beam on the second grid 46 on the string like hot cathode side becomes sufficient. If the application voltage (70 V in the manufactured apparatus) of the second grid 46 is set to have a difference of 20 V or less from the 0N voltage (80 V in the manufactured apparatus) of the control electrode 4, the influence of a variation in the distance between the second grid 46 and the control electrode 4 is reduced, thus contributing to a decrease in luminance unevenness.

EXAMPLE 6

Figure 10:
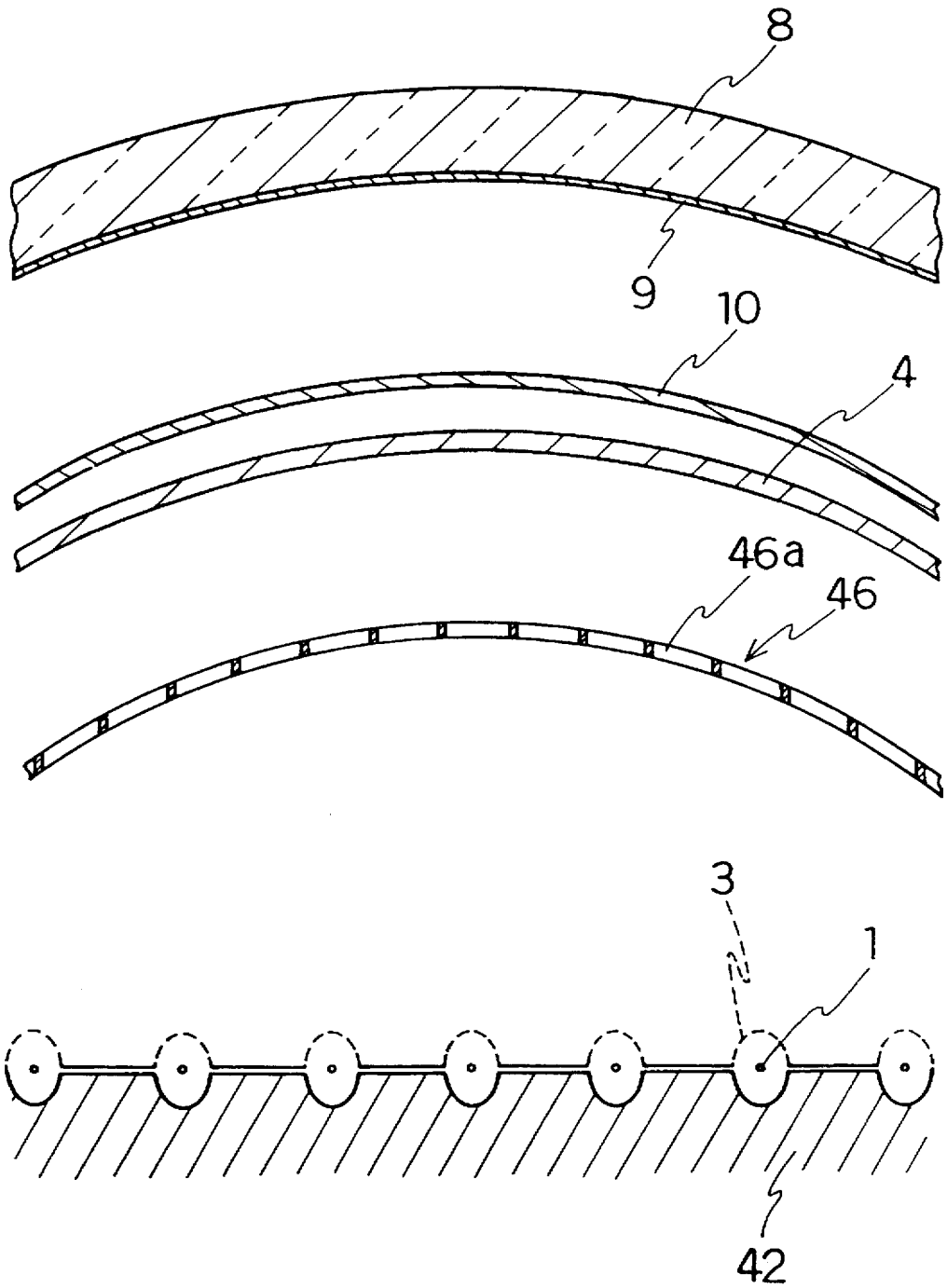
FIG. 10 is a fragmentary front section of the arrangement of yet another example of the image display apparatus according to the present invention.

FIG. 10 is a fragmentary sectional view of yet another example of the image display apparatus according to the present invention. Example 6 is of the same arrangement as Example 5 except that the second grid 46 is comprised of a curved surface having a curvature substantially the same curvature of the front glass 8. For instance, the second grid 46 is comprised of a curved surface having a radius of curvature of about 2000 mm, which is substantially the same curvature of the front glass 8, and the distance between the second grid 46 and the control electrode 4 is set to 5 mm. In this case, the distance between the second grid 46 and the perforated cover electrode 3 is about 15 mm a minimum and about 35 mm at a maxmium. Here, the electron beam is made uniform and flat by virtue of the configurations of the string like hot cathode 1 and perforated cover electrode 3. Hence, the influence of a variation in the distance between the second grid 46 and the perforated cover electrode 3 is small though a gentle luminance unevenness occurs in the arrangement pitch direction of the string like hot cathodes 1. Further, the ratio of the distance between the second grid 46 and the perforated cover electrode 3 to the arrangement pitch of the string like hot cathodes 1 is 1.25 to 2.9. Such ratio is preferably set within the range of 1.0 to 6.0, more desirably 1.4 to 3.5. When the ratio is less than 1, the uniformity ratio of the electron beam on the second grid 46 on the string like hot cathode side is insufficient, causing keen luminance unevenness. When the ratio exceeds 6.0, the rate of the electron beam utilized at a fixed voltage decreases.

EXAMPLE 7

Figure 11:
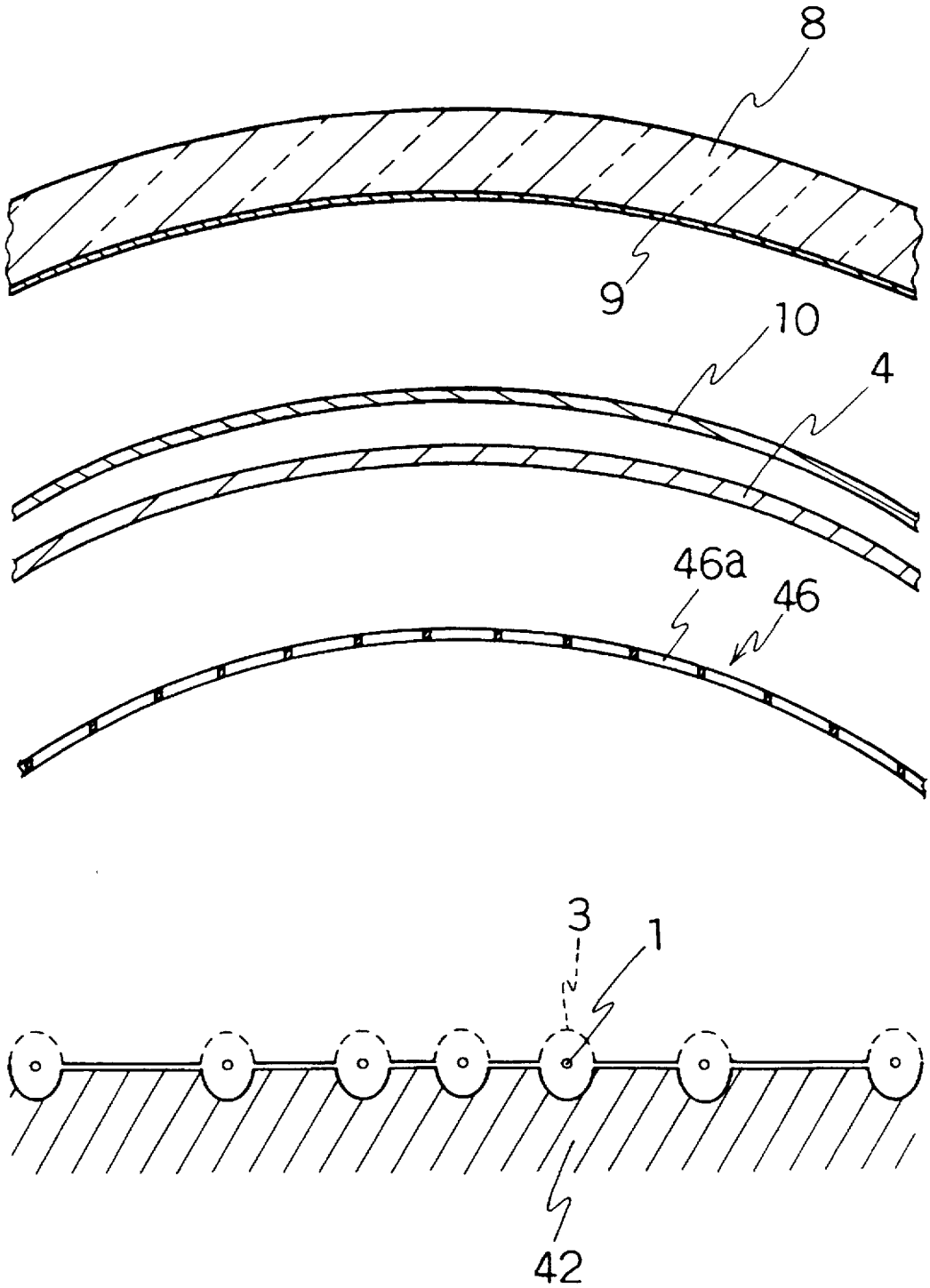
FIG. 11 is a fragmentary front section of the arrangement of yet another example of the image display apparatus according to the present invention.

FIG. 11 is a fragmentary sectional view of yet another example of the image display apparatus according to the present invention. As shown in FIG. 11, Example 7 is of the same arrangement as Example 6 except that the arrangement pitch of string like hot cathodes 1 is gradually varied as viewed from the central portion of the screen to a peripheral portion thereof in accordance with a variation in the distance between the perforated cover electrode 3 and the second grid 46. For instance, the arrangement pitch of string like hot cathodes 1 is gradually varied so as to assume 8 mm in the central portion of the screen and 16 mm in a peripheral portion thereof. Such arrangement allows the density of cathodes to increase in the central portion largely spaced apart from the second grid 46 or control electrode 4, hence, the quantity of electron beams to increase. This contributes to a further improvement in the uniformity ratio of the electron beam on the second grid 46 on the string like hot cathode side.

In raising the uniformity ratio of the electron beams sufficiently, the power consumption at the string like hot cathode 1 and the perforated cover electrode 3 may increase since the arrangement pitch of string like hot cathodes 1 has to be decreased. Nevertheless, the power consumption can be decreased if the back electrode 42 is divided and driven synchronously by scanning along a scanning line so as to control the emission of the electron beams. In this way, the uniformity ratio of the electron beams can assuredly be improved without degrading the characteristics of the flat-type image display apparatus.

EXAMPLE 8

Figure 12:
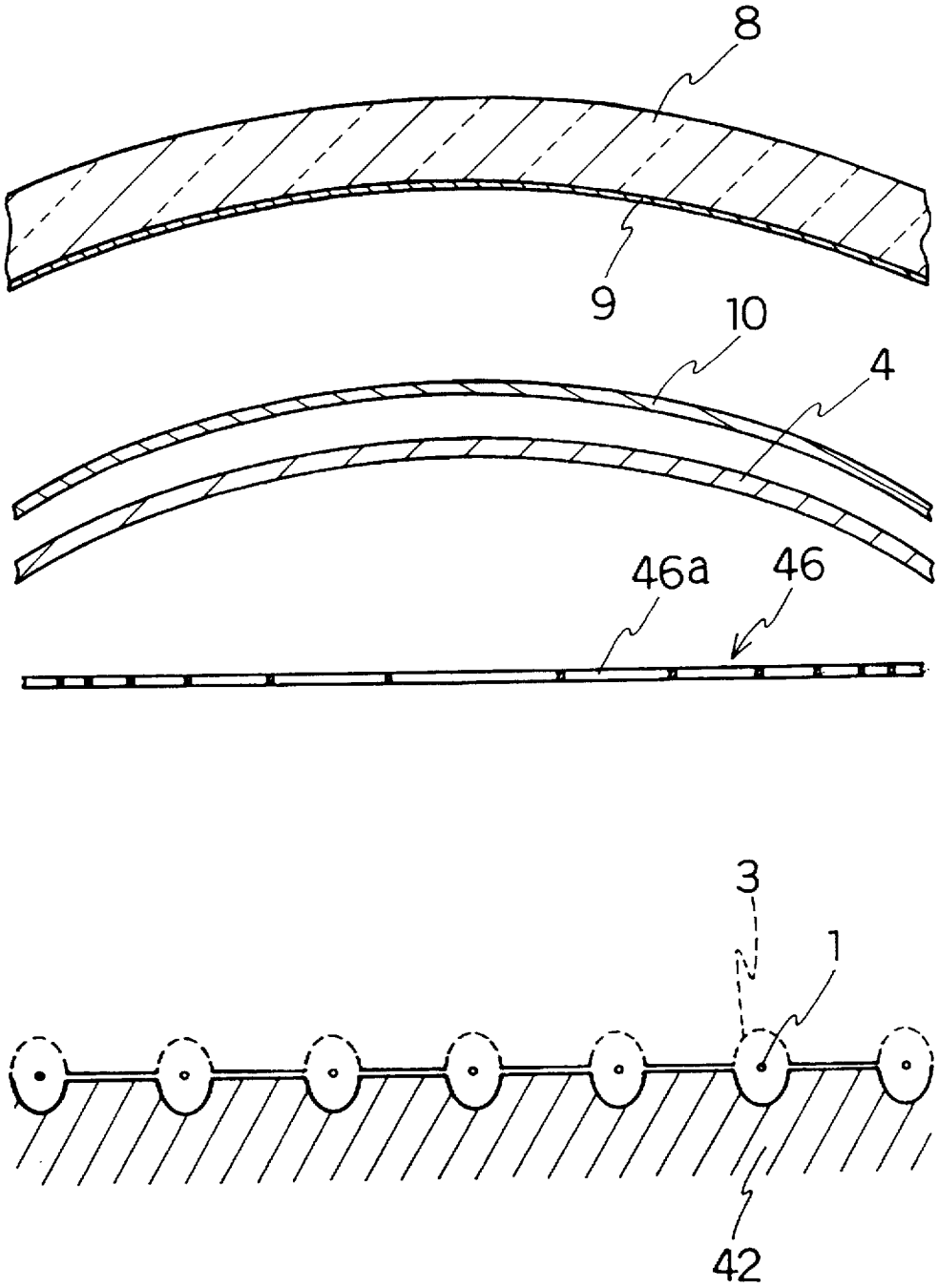
FIG. 12 is a fragmentary front section of the arrangement of yet another example of the image display apparatus according to the present invention.

FIG. 12 is a fragmentary sectional view of yet another example of the image display apparatus according to the present invention. As shown in FIG. 12, Example 8 is of the same arrangment as Example 5 except that the pitch of electron-pass apertures **46*a* of the second grid 46 is varied in accordance with a variation in the distance between the second grid 46 and the control electrode 4. Further, the rate of hole area of the electron-pass apertures 46*a* may be varied. For instance, in a portion of the second grid corresponding to the central portion of the display screen the electron-pass apertures 46*a* comprise 2.3 mm-square apertures defined at 2.5 mm pitch, while comprising 1.5 mm-square apertures defined at 1.7 mm pitch in a portion of the second grid corresponding to the peripheral portion of the screen. In this way, the aperture size and pitch are gradually varied as viewed from the central portion of the screen to the peripheral portion thereof. In such arrangement, the electron beam pass-through efficiency is high in a portion of the second grid where the aperture pitch or the rate of hole area is large, assuring a further improvement in the uniformity ratio of electron beam on the second grid 46 on the string like hot cathode side in the arrangement pitch direction of the string like hot cathodes 1**.

Although in Example 8 the rate of hole area of the second grid 46 is varied as viewed from the central portion of the screen to the peripheral portion thereof in the arrangement pitch direction of the perforated cover electrodes 3 and string like hot cathodes 1, the rate of hole area of the perforated cover electrode 3 may be varied likewise, or the rates of hole area of the perforated cover electrode 3 and second grid 46 may be varied at the same time.

EXAMPLE 9

Figure 13:
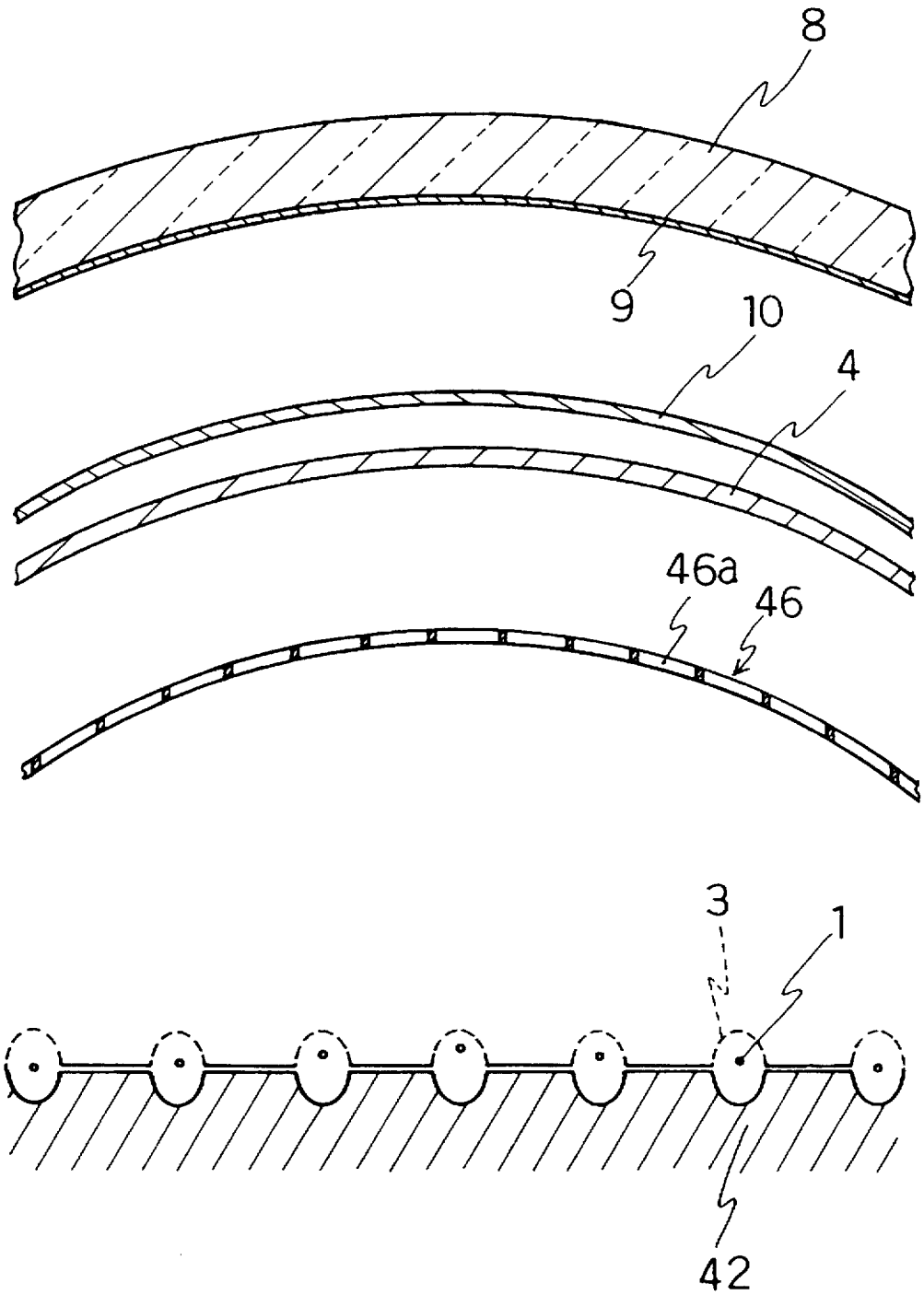
FIG. 13 is a fragmentary front section of the arrangement of yet another example of the image display apparatus according to the present invention.

FIG. 13 is a fragmentary sectional view of yet another example of the image display apparatus according to the present invention. As shown in FIG. 13, Example 9 is of the same arrangement as Example 6 except that the distance between the string like hot cathode 1 and the perforated cover electrode 3 is gradually varied in the arrangement pitch direction of the string like hot cathode 1 in accordance with a variation in the distance between the perforated cover electrode 3 and the second grid 46. For instance, in the central portion of the display screen the distance between the perforated cover electrode 3 and the string like hot cathode 1 on the major axis of the ellipse is set to 2 mm, while in the peripheral portion of the display screen it is set to 3 mm. In this way, the distance between the perforated cover electrode 3 and the string like hot cathode 1 on the major axis of the ellipse is gradually increased as viewed from the central portion of the screen to the peripheral portion thereof. When the distance between the perforated cover electrode 3 and the string like hot cathode 1 is small, a large amount of electrons are drawn out, while when the distance is large, the amount of electrons drawn out is decreased. Hence, by facilitating the emission of electron from the string like hot cathode 1 at a location relatively far from the second grid 46, the uniformity ratio of electron beam on the second grid 46 on the string like hot cathode side is improved in the arrangement pitch direction of the string like hot cathodes 1.

EXAMPLE 10

Figure 14:
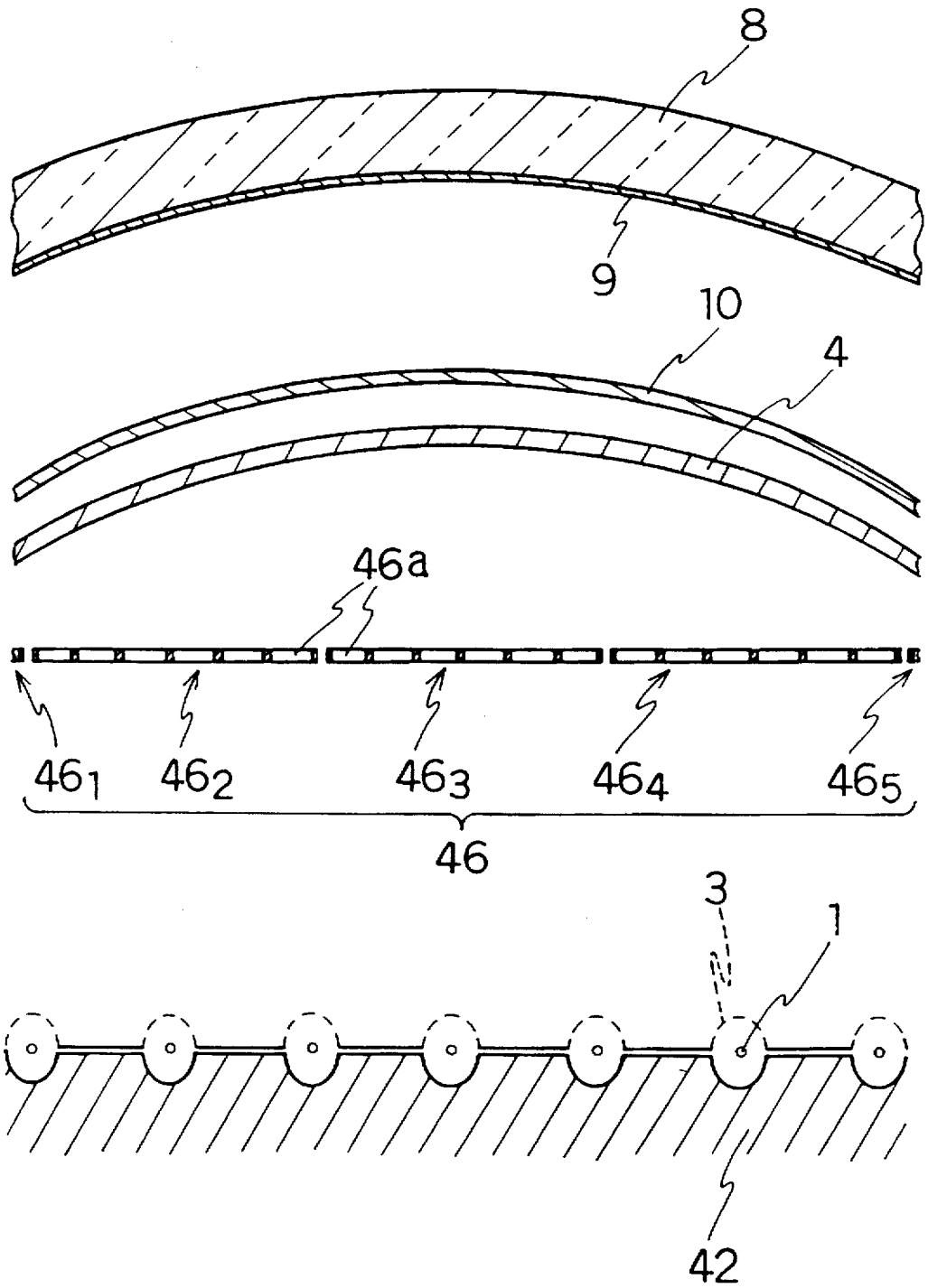
FIG. 14 is a fragmentary front section of the arrangement of yet another example of the image display apparatus according to the present invention.

FIG. 14 is a fragmentary sectional view of yet another example of the image display apparatus according to the present invention. As shown in FIG. 14, Example 10 is of the same arrangement as Example 5 except that the second grid 46 is divided in the arrangement pitch direction of the string like hot cathodes 1 and the divided grids are applied with respective voltages which are different. Like the focusing electrode of Example 1, the second grid 46 is preferably divided into about three to about nine portions. For example, the second grid 46 is divided into five portions, a divided portion $\mathbf{46}_3$ of the second grid 46 which is coincident with the central portion of the display screen is applied with a voltage of 90 V, and divided portions $\mathbf{46}_2$ and $\mathbf{46}_4$ thereof coincident with peripheral portions of the screen are applied with a voltage of 60 V. The voltage applied to the second grid 46 is gradually varied so that the variation in potential of the second grid 46 will be developed gently as viewed from the central portion to the peripheral portion of the screen. Such arrangement balances the quantity of emitted electrons at a portion of the second grid 46 relatively near the string like hot cathode 1 or the control electrode 4 since such a portion is applied with a low voltage. This results in a further improvement in the uniformity ratio of the electron beams on the second grid 46 on the string like hot cathode side.

EXAMPLE 11

Figure 15:
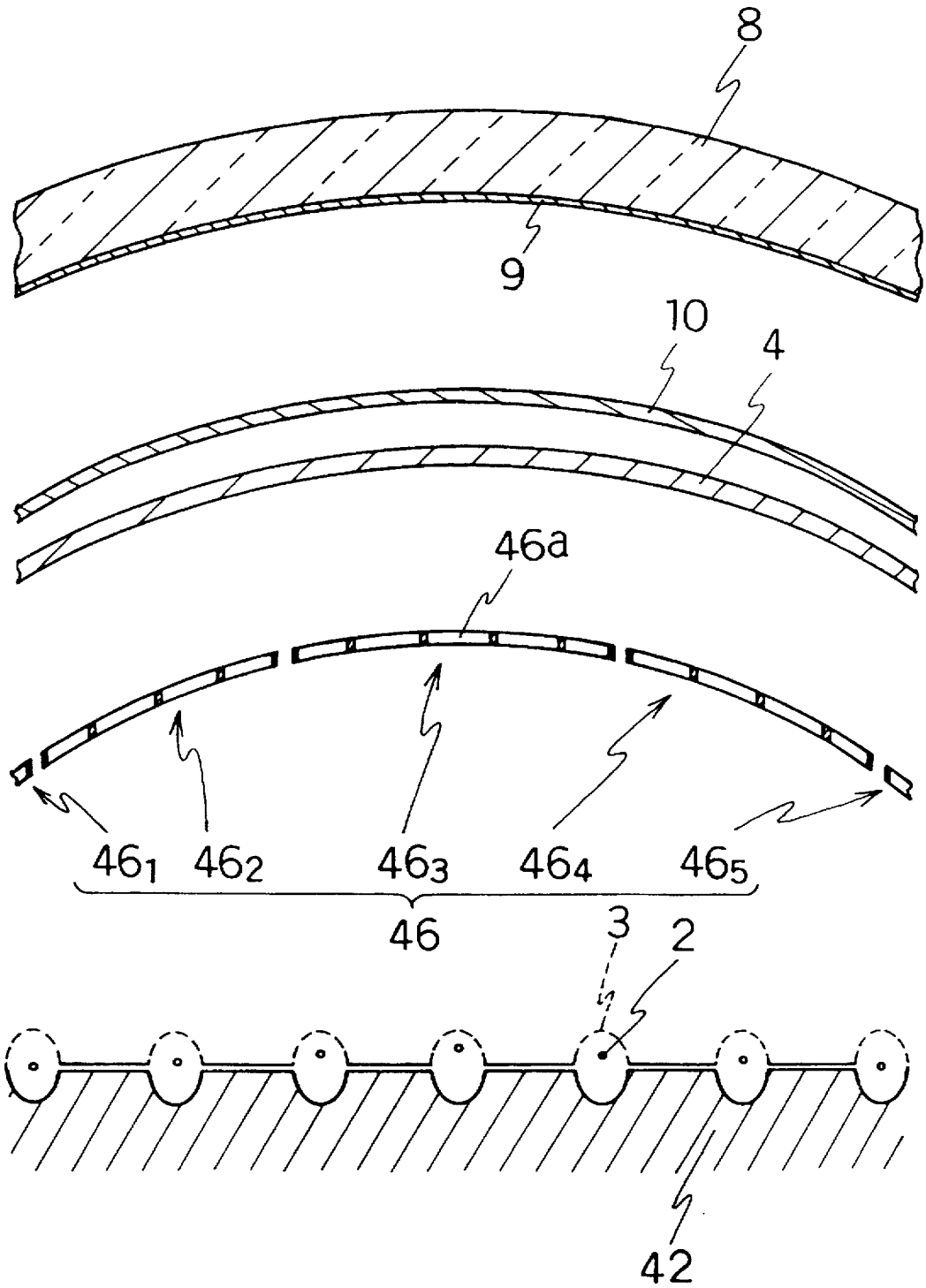
FIG. 15 is a fragmentary front section of the arrangement of yet another example of the image display apparatus according to the present invention.
Figure 16:
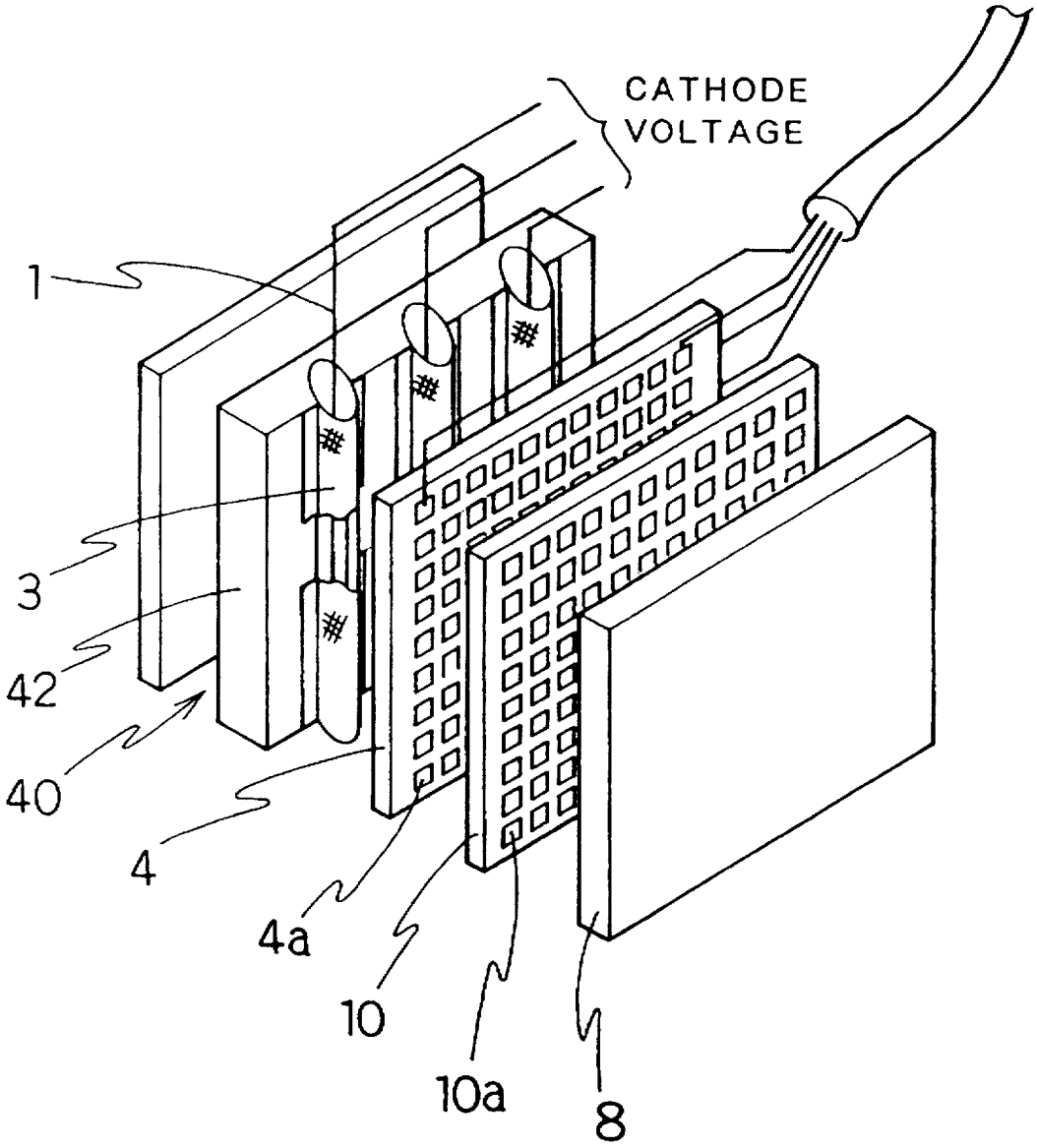
FIG. 16 is an exploded perspective view of the arrangement of an example of a conventional image display apparatus.
Figure 17:
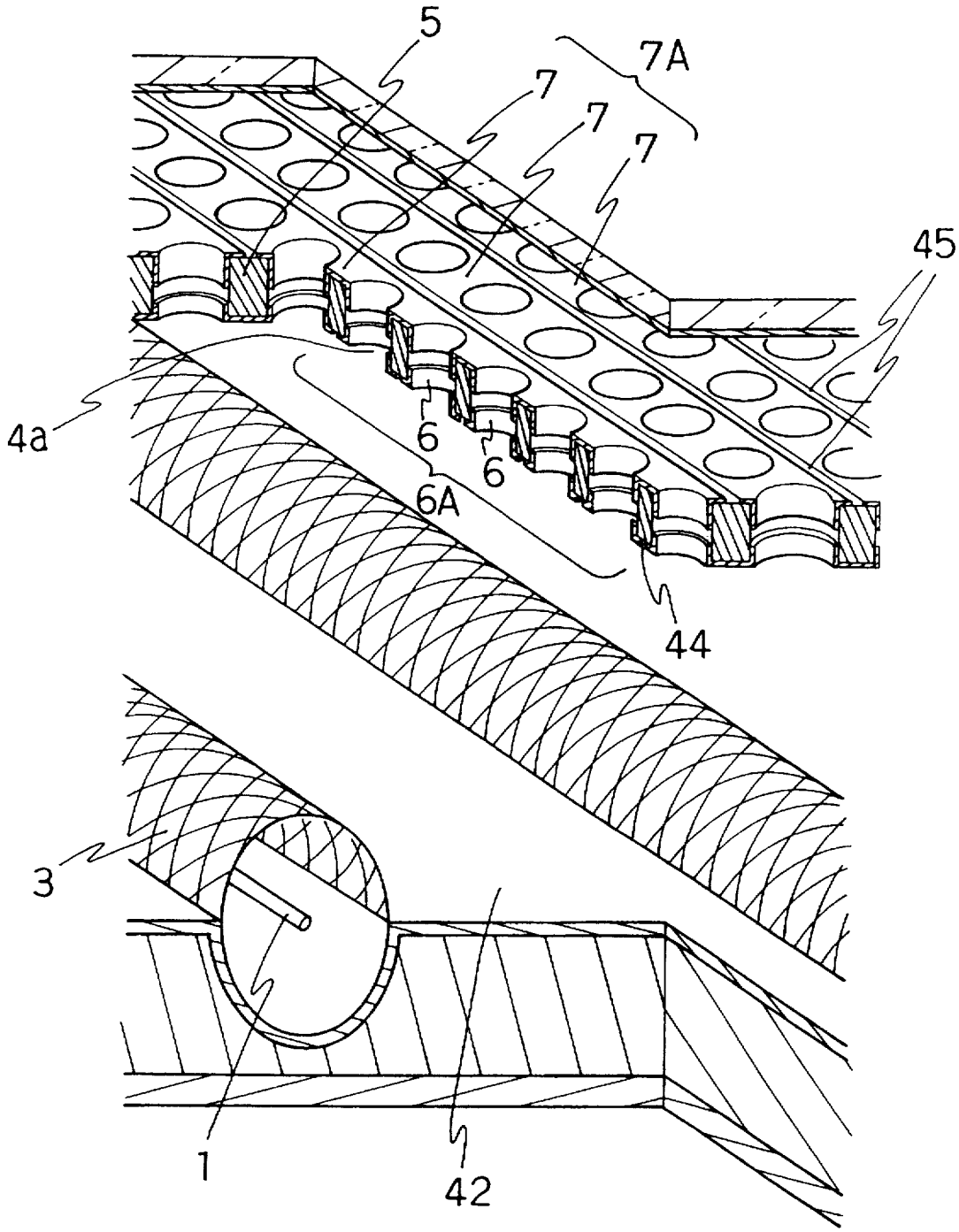
FIG. 17 is a partially cut-away enlarged view of a principal part of another example of a conventional image display apparatus.
Figure 18:
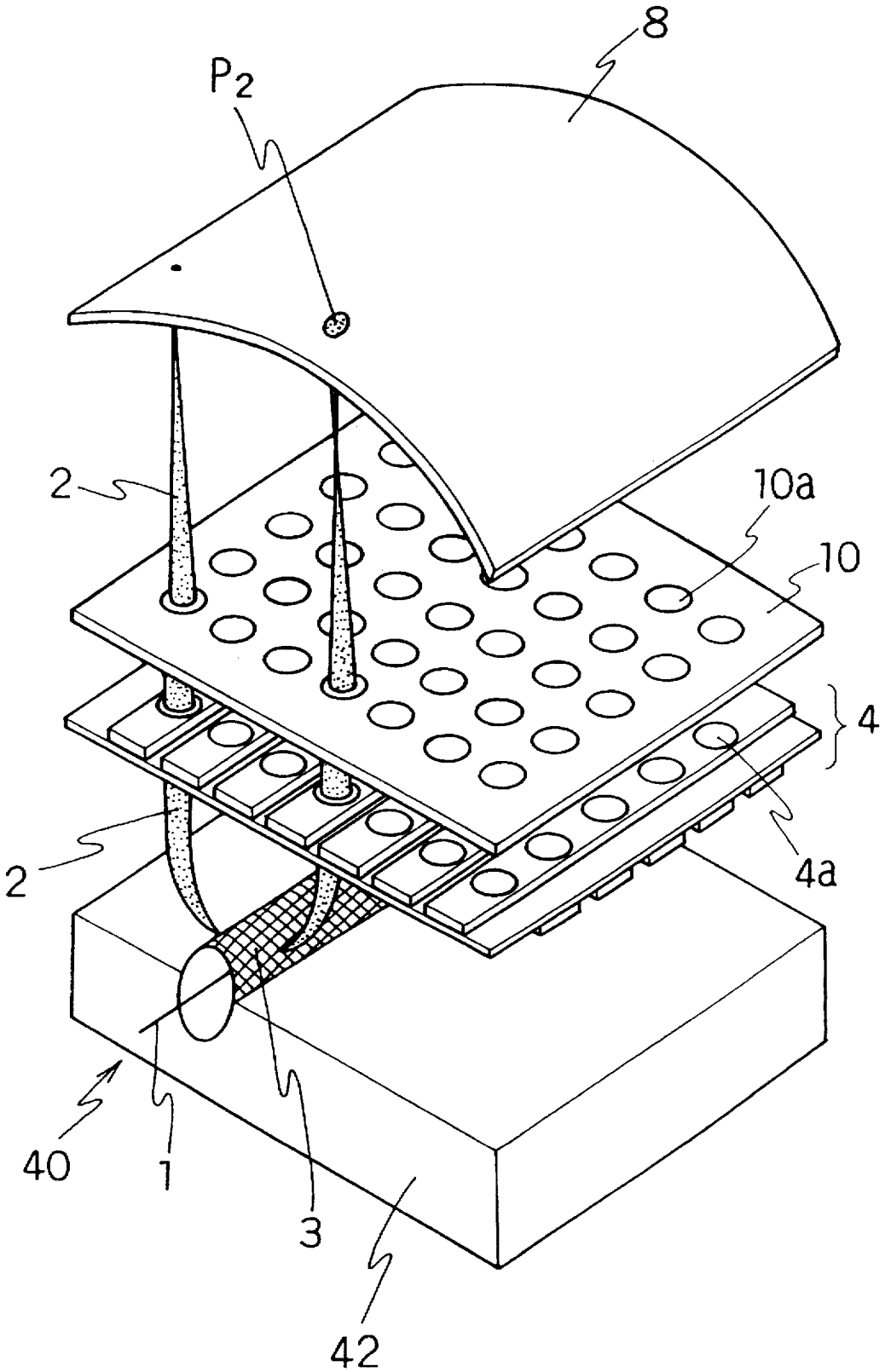
FIG. 18 is an exploded perspective view of yet another example of a conventional image display apparatus.
Figure 19A:
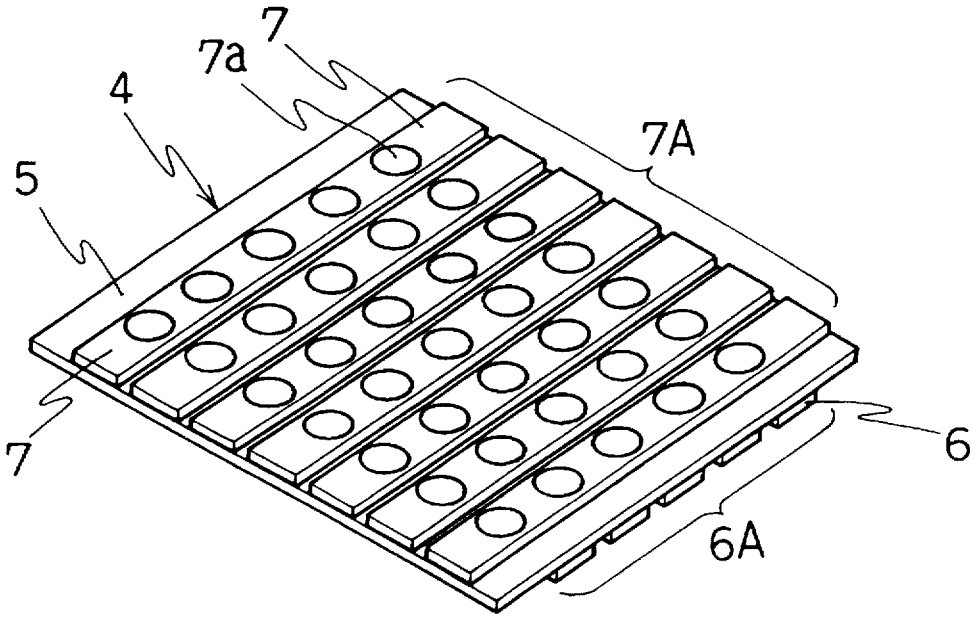
FIGS. 19(*a*) and 19(*b*) are enlarged perspective views of the control electrode shown in FIG. 19.
Figure 19B:
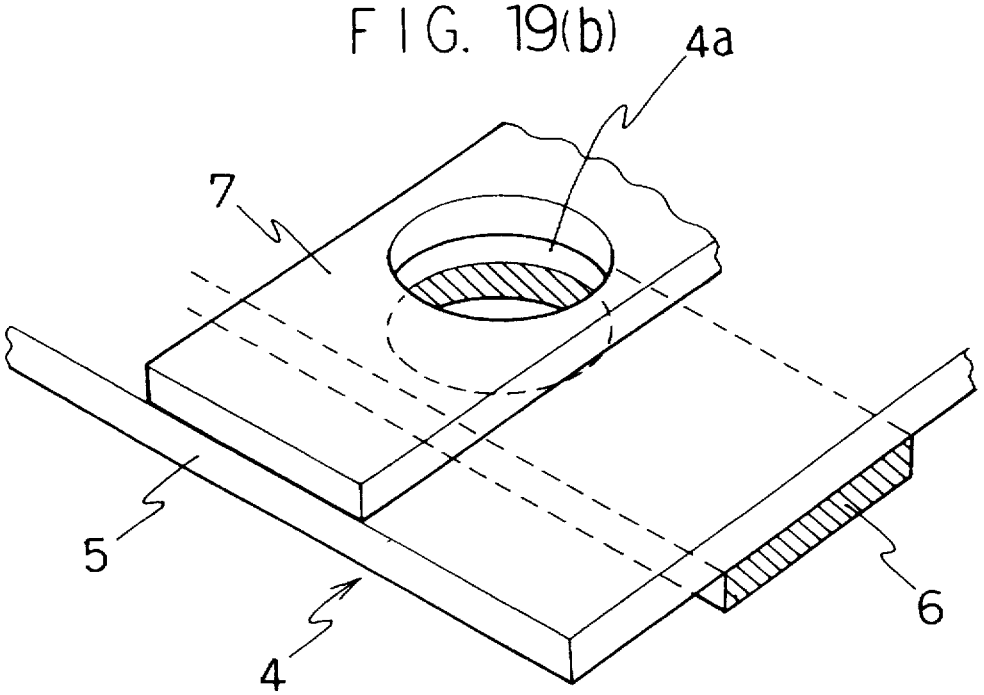
Figure 20A:
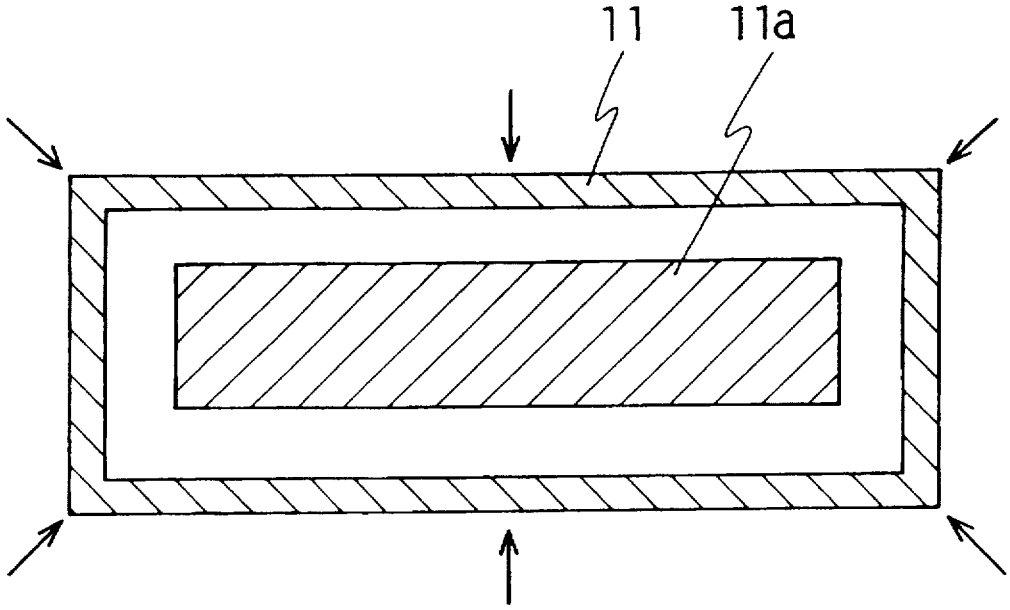
FIGS. 20(*a*) and 20(*b*) are schematic representations for illustrating the relation between the schematic shape of a vacuum enclosure and the stress concentration.
Figure 20B:
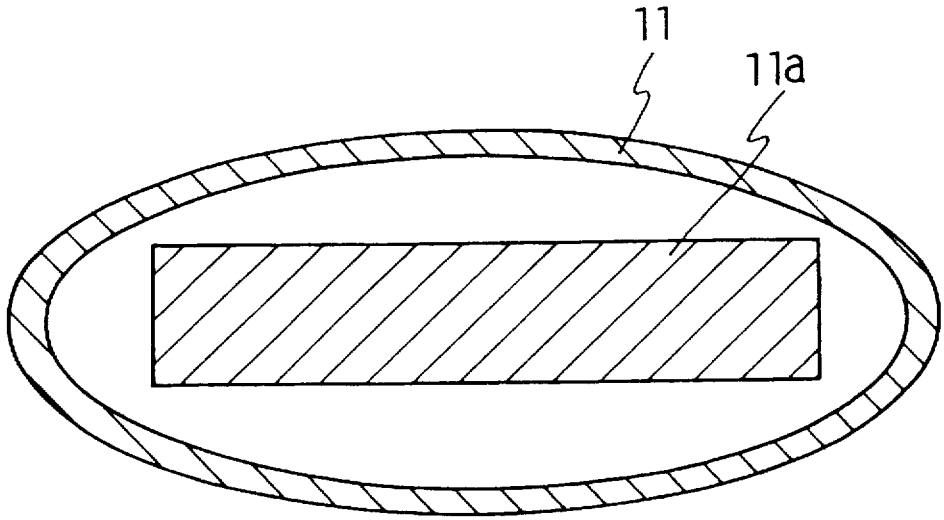
Figure 21:
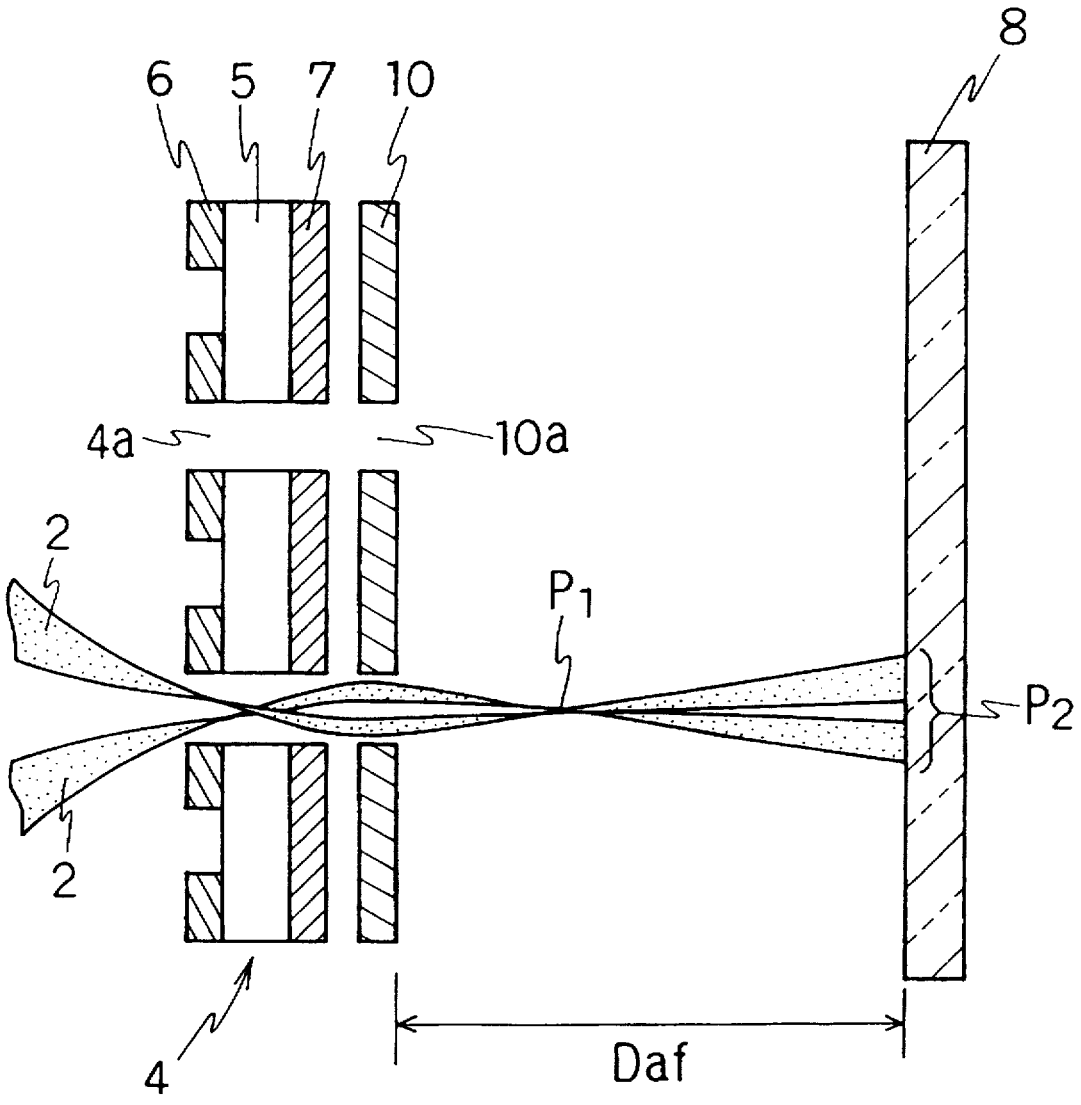
FIG. 21 is a schematic representation for illustrating the path of electron beam and an electro-optical lens comprising the focusing electrode.
Figure 22:
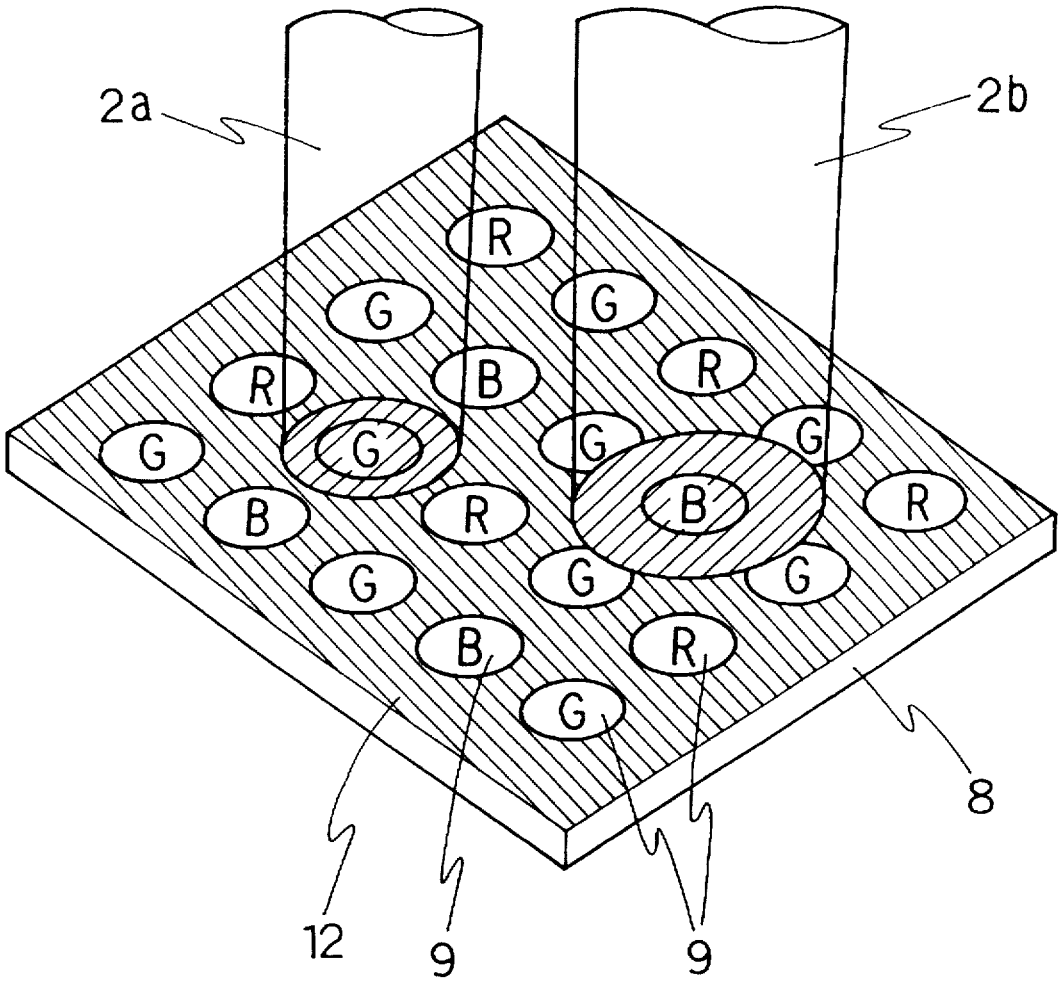
FIG. 22 is a perspective view for illustrating the relation between the beam diameter of electron beam and a dot of a luminous element.

FIG. 15 is a fragmentary sectional view of yet another example of the image display apparatus according to the present invention. As shown in FIG. 15, Example 11 is of the same arrangment as Example 10 except that the second grid 46 is comprised of a curved surface. The second grid 46 has a curvature substantially the same as the curvature of the control electrode 4 and further is divided in the arrangement pitch direction of the string like hot cathodes 1, the resulting divided grids being applied with respective voltages which are different. For example, the second grid 46 is divided into five portions, a divided portion $\mathbf{46}_3$ of the second grid 46 which is coincident with the central portion of the display screen is applied with a voltage of 90 V, and divided portions $\mathbf{46}_2$ and $\mathbf{46}_4$ thereof coincident with peripheral portions of the screen are applied with a voltage of 60 V. The voltage applied to the second grid 46 is gradually varied so that a variation in potential of the second grid 46 will be developed gently as viewed from the central portion to the peripheral portion of the screen. Further, the second grid 46 is comprised of a curved surface having a radius of curvature of about 2000 mm and is disposed as spaced by 5 mm apart from the control electrode. Like Example 10, such arrangement allows the uniformity ratio of the electron beams on the second grid 46 on the string like hot cathode side to be further improved than in Example 5.

Although the vacuum enclosure 43 is formed of glass in the foregoing Examples, it may be a vacuum enclosure comprising a sealed metallic enclosure instead of the part of the enclosure 43 other than at least the front glass 8 to be provided with the luminous element 9, the front glass 8 being formed integrally with the sealed metallic enclosure by frit-bonding or like means.

Further, although the string like hot cathodes 1 and the perforated cover electrodes 3 are disposed on a flat plane in the foregoing Examples, these electrodes may be disposed on a curved surface having a curvature larger than that of the inner wall of the vacuum enclosure on at least the side where the luminous element 9 is provided unless the reliability of those electrodes is substantially degraded.

It should be appreciated that although the cathode comprises a string like hot cathode in Examples 5 to 11, these Examples, like Example 4, may employ a hot cathode of a structure different from the string like structure, a cathode of a field emission type electron gun or a thermionic emission type cathode. Such an arrangement also assures effects similar to those of the foregoing Examples.

In addition, combining the features of two or more Examples will afford a further improved image display apparatus.

As has been described, according to the present invention the division of the focusing electrode allows application of different voltages to the divided focusing electrodes in accordance with the distance between the focusing electrode and the front glass. Therefore, the beam diameter of electron beam on the display screen can be made substantially uniform and minimized over the enire screen, thus resulting in an effect of displaying a clear image with a uniform luminance over the entire screen.

Also, it becomes possible to lighten and thin the vacuum enclosure with ease and to make each electrode flat and, hence, there is given an effect such that the minimization of the manufacturing cost can be realized.

Further, according to the present invention, the image display apparauts is arranged such that the inner wall of the vacuum enclosure on at least the side where the luminous element is provided, namely the luminous element, the focusing electrode and the control electrode comprise respective curved surfaces having a substantially the same curvature, that the second grid is disposed between the control electrode and the perforated cover electrode, and that the perforated cover electrode and the cathode are disposed on a curved surface having a curvature substantially larger than that of the aforesaid curvature or on a flat plane. Such an arrangement offers the effects of: mitigating deformation of the perforated cover electrode during operation, the temperature of the perforated cover electrode being likely to be significantly elevated due to its location adjacent the cathode serving as a heat source and the impingement of electrons thereon; minimizing the luminance unevenness;

reducing the shortening of the cathode life; and improving the reliability of the perforated cover electrode and that of the cathode. As a result, a highly reliable image display apparatus of a prolonged life is obtained which is capable of displaying a clear image with a uniform luminance over the entire screen.

Also, by making the second grid have a curvature substantially the same as the curvature of the control electrode, an image display with further improved luminance and luminance uniformity is feasible.

Furthermore, by increasing the arrangement pitch of the perforated cover electrodes and cathodes as viewed from the central portion to the peripheral portion of the screen, the flat-type image display apparatus enjoys substantially improved luminance uniformity while minimizing the influence on other characteristics thereof.

We claim:

1. An image display apparatus comprising:

a cathode for emitting electrons;

a perforated cover electrode for leading out and accelerating the electrons emitted from the cathode;

a flat shaped control electrode disposed almost parallel with the cathode and having an electron-pass aperture permitting the emitted electrons to pass therethrough, the control electrode being adapted to control an electron beam passing through the electron-pass aperture;

a luminous element which emits light when irradiated with the emitted electrons and is formed on a curved screen panel; and a focusing electrode disposed between the control electrode and the luminous element and having an electron-pass aperture and a means for correcting the beam diameter of the electron beam on the luminous element which varies in accordance with a variation in the distance between the luminous element and the control electrode, wherein said means for correcting creates at least two kinds of the electron beams having different focal points from the focusing electrode.

2. The image display apparatus of claim 1, wherein said focusing electrode is divided into divisional focusing electrodes, and wherein the divisional focusing electrodes are applied with at least two different voltages.

3. The image display apparatus of claim 2, wherein the voltage applied to each of said divisional focusing electrodes is such that a voltage obtained by subtracting the on-voltage of said control electrode from the voltage applied to each of said divisional focusing electrodes is in substantially inverse proportion to the distance between said focusing electrode and said luminous element.

4. The image display apparatus of claim 2, wherein the voltage applied to each of said divisional focusing electrodes is supplied by way of resistive division.

5. An image display apparatus comprising:

a cathode for emitting electrons;

a perforated cover electrode for leading out and accelerating the electrons emitted from the cathode;

a control electrode disposed almost parallel with the cathode and having an electron-pass aperture permitting the emitted electrons to pass therethrough, the control electrode being adapted to control an electron beam passing through the electron-pass aperture;

a luminous element which emits light when irradiated with the emitted electrons and is formed on a curved screen panel; and a focusing electrode disposed between the control electrode and the luminous element, wherein said focusing electrode is disposed such that the ratio of the distance between said focusing electrode and said control electrode to that between said focusing electrode and said luminous element is substantially constant over an entire display screen.

6. An image display apparatus comprising:

a cathode for emitting electrons;

a perforated cover electrode for leading out and accelerating the electrons emitted from the cathode;

a control electrode disposed almost parallel with the cathode and having an electron-pass aperture permitting the emitted electrons to pass therethrough, the control electrode being adapted to control an electron beam passing through, the electron-pass aperture;

a luminous element which emits light when irradiated with the emitted electrons and is formed on a curved screen panel; and a focusing electrode disposed between the control electrode and the luminous element and having an electron-pass aperture and a means for correcting the beam diameter of the electron beam on the luminous element comprising said electron-pass aperture of the focusing electrode having a size of said electron-pass aperture which is varied in accordance with the distance between said focusing electrode and said luminous element.

7. The image display apparatus of claim 1, wherein said cathode is a hot cathode which emits thermoelectrons.

8. An image display apparatus comprising:

a cathode for emitting electrons;

a perforated cover electrode for leading out and accelerating the electrons emitted from the cathode;

a control electrode disposed substantially parallel with the cathode and having an electron-pass aperture permitting the emitted electrons to pass therethrough, the control electrode being adapted to control an electron beam passing through the electron-pass aperture;

a luminous element which emits light when irradiated with the emitted electrons; and a focusing electrode disposed between the control electrode and the luminous element, the focusing electrode being divided into at least two electrodes, each of said at least two electrodes being independently controlled, and including a plurality of electron-pass apertures through which the electron beam passes.

9. An image display apparatus comprising:

a cathode for emitting electrons;

a perforated cover electrode for leading out and accelerating the electrons emitted from the cathode;

a control electrode having an electron-pass aperture permitting the emitted electrons to pass therethrough and adapted to control an electron beam passing through the electron-pass aperture;

a luminous element which emits light when irradiated with the emitted electrons;

a focusing electrode disposed between the control electrode and the luminous element and having an electron-pass aperture permitting the emitted electrons to pass therethrough; and a second grid disposed between the control electrode and the perforated cover electrode and having an electron-pass aperture for correcting the brightness of the luminous element which varies in accordance with a variation in the distance between the luminous element and the perforated cover electrode;

the luminous element, the focusing electrode and the control electrode comprising respective curved surfaces having almost the same curvature, the perforated cover electrode and the cathode respectively comprising a plurality of perforated cover electrodes and a plurality of cathodes, the perforated cover electrodes and the cathodes being arranged in an array on a curved surface having a curvature larger than said curvature or on a flat plane.

10. The image display apparatus of claim 9, wherein said second grid comprises a curved surface having a curvature larger than said curvature.

11. The image display apparatus of claim 9, wherein said second grid comprises a curved surface having a curvature substantially the same as a curvature of said control electrode.

12. The image display apparatus of claim 9, wherein said perforated cover electrodes and said cathodes are arranged at an increasing pitch as viewed in the direction from a central portion to a peripheral portion thereof.

13. The image display apparatus of claim 9, wherein the distance between the curved surface or the flat plane on which said perforated cover electrodes and said cathodes are arranged and said second grid is 1.0 to 6.0 times as large as the pitch at which said cathodes are arranged in the array.

14. The image display apparatus of claim 9, wherein said second grid or said perforated cover electrode is formed such that at least one of said second grid and said perforated cover electrode has a rate of hole area which is large in a central portion thereof and small in a peripheral portion thereof as viewed in an arrangement pitch direction of said perforated cover electrodes and said cathodes.

15. The image display apparatus of claim 9, wherein said perforated cover electrode and said cathode are disposed such that the distance therebetween is large in a central portion and small in a peripheral portion as viewed in an arrangement pitch direction of said perforated cover electrodes and said cathodes.

16. The image display apparatus of claim 9, wherein said second grid is divided into at least three portions in an arrangement pitch direction, and wherein a divisional portion centrally lying of said second grid is applied with a large voltage, while a divisional portion peripherally lying of said second grid is applied with a small voltage.

17. The image display apparatus of claim 9, wherein said second grid is a flat plane.

* * * * *